US008284632B2

(12) United States Patent
Watanabe

(10) Patent No.: US 8,284,632 B2
(45) Date of Patent: Oct. 9, 2012

(54) CALENDAR MECHANISM EQUIPPED TIMEPIECE INCLUDING TWO DATE INDICATORS

(75) Inventor: Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 223 days.

(21) Appl. No.: 12/806,996

(22) Filed: Aug. 25, 2010

(65) Prior Publication Data

US 2011/0058455 A1 Mar. 10, 2011

(30) Foreign Application Priority Data

Sep. 7, 2009 (JP) ..... 2009-206006

(51) Int. Cl.
*G04B 19/20* (2006.01)

(52) U.S. Cl. ..... 368/37

(58) Field of Classification Search ..... 368/28, 368/34–38

See application file for complete search history.

(56) References Cited

U.S. PATENT DOCUMENTS

| | | | | |
|---|---|---|---|---|
| 7,839,724 | B2 * | 11/2010 | Schmiedchen et al. | 368/37 |
| 2005/0232085 | A1 * | 10/2005 | Scheufele | 368/37 |
| 2006/0002237 | A1 * | 1/2006 | Takahashi | 368/28 |
| 2006/0133214 | A1 * | 6/2006 | Suzuki | 368/37 |
| 2007/0047390 | A1 | 3/2007 | Suzuki | 368/37 |
| 2007/0047391 | A1 | 3/2007 | Suzuki et al. | 368/37 |
| 2008/0013406 | A1 * | 1/2008 | Dancsecs et al. | 368/37 |

FOREIGN PATENT DOCUMENTS

| | | |
|---|---|---|
| EP | 0999482 | 5/2000 |
| EP | 1070996 | 1/2001 |
| WO | 98 50829 | 11/1998 |

* cited by examiner

*Primary Examiner* — Vit W Miska
(74) *Attorney, Agent, or Firm* — Adams & Wilks

(57) ABSTRACT

To provide a calendar mechanism equipped timepiece which, being small and thin, includes two date indicators configuring date characters which are large and easy to see. A calendar mechanism equipped timepiece of the invention includes a first date indicator which displays the ones column of the date, a second date indicator which displays the tenths column of the date, and a program wheel which enables each of the first date indicator and second date indicator to rotate intermittently. The program wheel includes program wheel teeth, first date indicator advance teeth, second date indicator advance teeth having provided at the leading ends thereof second date indicator advance fingers, and correction teeth. A configuration is such that the height of the second date indicator advance teeth is greater than the height of the first date indicator advance teeth, and the height of the first date indicator advance teeth is greater than the height of the correction teeth.

5 Claims, 26 Drawing Sheets

CALENDAR MECHANISM EQUIPPED TIMEPIECE INCLUDING TWO DATE INDICATORS

BACKGROUND OF THE INVENTION

1. Field of the Invention

The present invention relates to a calendar mechanism equipped timepiece which displays the date with two date indicators. More particularly, the invention relates to a calendar mechanism equipped timepiece including a first date indicator, which displays the ones column of the date, a second date indicator, which displays the tenths column of the date, and a program wheel for advancing the first date indicator and second date indicator.

2. Description of the Related Art (1) Description of Terminology:

In general, a mechanical body including the drive portion of a timepiece is referred to as a "movement". A condition in which a dial and hands are mounted on the movement, and housed in a timepiece case, thus forming a completed product is referred to as a "complete" of the timepiece. Of the two sides of a main plate configuring the substrate of the timepiece, a side on which glass of the timepiece case exists, that is, a side on which the dial exists, is referred to as the "back side", "glass side", or "dial side" of the movement. Of the two sides of the main plate, a side on which the case back of the timepiece case exists, that is, the side opposite to that of the dial, is referred to as the "front side" or "back case side" of the movement. A train wheel mounted on the "front side" of the movement is referred to as a "front train wheel". A train wheel mounted on the "back side" of the movement is referred to as a "back train wheel". In general, a "12 o'clock side" refers, in an analog timepiece, to a side on which a calibration corresponding to 12 o'clock on the dial is disposed. A "12 o'clock direction" refers, in the analog timepiece, to a direction toward the "12 o'clock side" from the rotation center of the hands. Also, a "3 o'clock side" refers, in the analog timepiece, to a side on which a calibration corresponding to 3 o'clock on the dial is disposed. A "3 o'clock direction" refers, in the analog timepiece, to a direction toward the "3 o'clock side" from the rotation center of the hands. Also, a "6 o'clock side" refers, in the analog timepiece, to a side on which a calibration corresponding to 6 o'clock on the dial is disposed. A "6 o'clock direction" refers, in the analog timepiece, to a direction toward the "6 o'clock side" from the rotation center of the hands. Also, a "9 o'clock side" refers, in the analog timepiece, to a side on which a calibration corresponding to 9 o'clock on the dial is disposed. A "9 o'clock direction" refers, in the analog timepiece, to a direction toward the "9 o'clock side" from the rotation center of the hands. Furthermore, there may be a case in which other sides, such as a "2 o'clock direction" and a "2 o'clock side", refer to sides on which other calibrations on the dial are disposed.

(2) Heretofore Known Calendar Mechanism Equipped Timepiece:

Hereafter, a description will be given of a configuration of a heretofore known calendar mechanism equipped timepiece including a first date indicator, which displays the ones column of the date, and a second date indicator, which displays the tenths column of the date.

(2•1) Heretofore Known First Type Calendar Mechanism Equipped Timepiece:

A heretofore known first type calendar mechanism equipped timepiece, including a ones column movable portion interlocking with a ones column star having ten teeth, and a tenths column movable portion interlocking with a tenths column star having four teeth, is configured so that the ones column star and tenths column star are directly driven by a ones column internal gear and a tenths column internal gear, provided one on each coronal gear (See, for example, Japanese Patent No. 3,322,678).

(2•2) Heretofore Known Second Type Calendar Mechanism Equipped Timepiece:

A heretofore known second type calendar mechanism equipped timepiece includes two date indicators, that is, a first date indicator and a second date indicator, which at least partially overlap each other. The first date indicator provides a ones column date display, and the second date indicator provides a tenths column date display. Numbers "0" and "1" to "9", that is, ten numbers are circumferentially provided on the first date indicator. Two sets of numbers "0" to "3", that is, eight numbers are circumferentially provided on the second date indicator. A drive mechanism includes a 24 hour wheel, which rotates once every 24 hours by means of the rotation of an hour wheel, an operation lever operated by means of the rotation of the 24 hour wheel, other control gears, and the like. A program wheel rotates by means of the operation of the operation lever, a first date indicator drive wheel rotates the first date indicator, and a second date indicator drive wheel rotates the second date indicator. The rotation of the first date indicator is set by a first date indicator jumper. The rotation of the second date indicator is set by a second date indicator jumper (See, for example, EP-A-1070996 A1).

(2•3) Heretofore Known Third Type Calendar Mechanism Equipped Timepiece:

A heretofore known third type calendar mechanism equipped timepiece includes a ones column disc, which displays the ones column of the date, and a tenths column disc, which displays the tenths column of the date. A ones column pinion is fixed to the ones column disc. A ones column jumper maintains the angular position of the ones column pinion. A tenths column pinion is fixed to the tenths column disc. A tenths column jumper maintains the angular position of the tenths column pinion. The ones column pinion meshes with the upper half of the tooth row of a date gear. Numbers "0" and "1" to "9", that is, ten numbers are circumferentially provided on the ones column disc. Two sets of numbers "0" to "3" and two "0"s, that is, ten numbers are circumferentially provided on the tenths column disc. Each hook of a drive device meshes with the tooth row of the date gear, thereby causing the teeth of the date gear to advance one step a day. The tenths column pinion is driven step by step by an intermediate movable part. The intermediate movable part is driven step by step via an idle gear by the date gear (See, for example, JP-A-2000-147148).

(2•4) Heretofore Known Fourth Type Calendar Mechanism Equipped Timepiece:

A heretofore known fourth type calendar mechanism equipped timepiece includes a first date indicator and a second date indicator, which display the ones column of the date, a third date indicator, which displays the tenths column of the date, and a program wheel, which can cause each of the first date indicator, second date indicator, and third date indicator to rotate intermittently based on the operation of a drive mechanism. It is possible to display the date with one of first date characters of the first date indicator and one of third date characters of the third date indicator, and display the date with one of second date characters of the second date indicator and one of the third date characters of the third date indicator (See, for example, JP-A-2007-93591).

With the heretofore known first type calendar mechanism equipped timepiece, a configuration is such that, the height of the coronal gear being two-tiered, the second date indicator is advanced by the lower gear, and the first date indicator is advanced by the upper gear. Furthermore, the teeth of the program wheel are below the lower gear, thus forming a three-layer structure as a whole. For this reason, there has been a problem in that the number of parts becomes larger, and the timepiece becomes thicker.

With the heretofore known second type calendar mechanism equipped timepiece, as a gear which advances the ones column date and a gear, which advances the tenths column date are stacked one on the other, there has been a problem in that the timepiece becomes thicker. With this type of calendar mechanism equipped timepiece, as a ones column date display plate and a tenths column date display plate are stacked one on the other, there has been a problem in that the timepiece becomes still thicker. With this type of calendar mechanism equipped timepiece, the program wheel is rotated one tooth via the operation lever 44 by a lever drive pin 46 provided on a date indicator driving wheel 48. Consequently, there has been a problem in that the drive mechanism is complex, and the area occupied by the drive mechanism becomes larger.

With the heretofore known third type calendar mechanism equipped timepiece, as the tenths column pinion is driven by the date gear via the intermediate movable part and idle gear, there has been a problem in that the drive mechanism for driving the tenths column disc is complex, and the area occupied by the drive mechanism becomes larger.

With the heretofore known fourth type calendar mechanism equipped timepiece, as it includes the first date indicator and second date indicator, which display the ones column of the date, and the third date indicator, which displays the tenths column of the date, there has been a problem in that the number of parts becomes larger, and the timepiece becomes thicker.

Furthermore, the heretofore known calendar mechanism equipped timepiece has had a problem in that the drive mechanism is complex, and the rotational load of the drive mechanism is large. Also, with the heretofore known calendar mechanism equipped timepiece, as numbers indicating ten days are provided in the circumferential direction of a date indicator, it has been difficult to increase the dimension of the numbers indicating the days.

SUMMARY OF THE INVENTION

It is an aspect of the present invention to configure a calendar mechanism equipped timepiece so as to include a date indicator displaying the ones column of the date and a date indicator displaying the tenths column of the date, and configure the timepiece so that a drive mechanism which drives the two date indicators is made compact with a simple structure. Also, it is another aspect of the present invention to provide a calendar mechanism equipped timepiece including date indicators having date characters which are large and easy to see. Also, it is still another aspect of the present invention to provide a calendar mechanism equipped timepiece with a small rotational load of a drive mechanism.

According to the invention, a calendar mechanism equipped timepiece which displays the date with two date indicators is configured so as to include a drive mechanism for driving the calendar mechanism equipped timepiece; time display wheels which rotate by means of the operation of the drive mechanism and display time information; a first date indicator which displays the ones column of the date; a second date indicator which displays the tenths column of the date; and a program wheel configured so as to enable each of the first date indicator and second date indicator to rotate intermittently based on the operation of the drive mechanism. The program wheel includes program wheel teeth for receiving the operation of the drive mechanism and advancing the program wheel; first date indicator teeth configured so as to advance the first date indicator; second date indicator teeth which can advance the first date indicator, and have provided at the leading ends thereof second date indicator advance fingers for advancing the second date indicator; and correction teeth configured so as to be unable to advance the first date indicator and unable to advance the second date indicator.

The first date indicator advance teeth, second date indicator advance teeth, and correction teeth are disposed on the outer side of the program wheel. The height of the second date indicator advance teeth is configured so as to be greater than the height of the first date indicator advance teeth, and the height of the first date indicator advance teeth is configured so as to be greater than the height of the correction teeth. The program wheel teeth for advancing the program wheel are provided on the program wheel as internal teeth.

With the calendar mechanism equipped timepiece of the invention, the first date indicator and second date indicator, whose perimeters are positioned in proximity to each other, are configured so that it is possible to display information relating to the date with one of first date characters provided on the first date indicator and one of second date characters provided on the second date indicator. With this configuration, it is possible to realize a calendar mechanism equipped timepiece wherein the drive mechanism which drives the first date indicator and second date indicator is configured simply and compactly. Also, with this configuration, it is possible to realize a calendar mechanism equipped timepiece including date indicators having date characters which are large and easy to see.

With the calendar mechanism equipped timepiece of the invention, it is preferable that the program wheel has 31 program wheel teeth for receiving the operation of the drive mechanism, that the number of first date indicator advance teeth provided is 25, the number of second date indicator advance teeth provided is four, and the number of correction teeth provided is two, and that the program wheel is configured in a kind of shape which is in one plane. With this configuration, it is possible to realize a calendar mechanism equipped timepiece which has a small number of parts, and is configured compactly.

With the calendar mechanism equipped timepiece of the invention, it is preferable that, in the first date indicator, first date characters formed of ten numbers are provided on a first date character display surface, and the first date characters are circumferentially disposed in the order of "0", "1", "2", "3", "4", "5", "6", "7", "8", and "9", and that, in the second date indicator, second date characters formed of eight numbers are provided on a second date character display surface, and the second date characters are circumferentially disposed in the order of "0", "1", "2", "3", "0", "1", "2", and "3". With this configuration, it is possible to realize a compactly configured calendar mechanism equipped timepiece. Also, with this configuration, it is possible to realize a calendar mechanism equipped timepiece including date indicators having date characters which are large and easy to see.

With the calendar mechanism equipped timepiece of the invention, it is preferable that it includes a calendar correction mechanism with which, in a condition in which a winding stem is pulled out to a winding stem position in which a calendar correction can be made, by the winding stem being rotated, it is possible to correct the display details of the first date indicator and the display details of the second date indicator, and that the calendar correction mechanism, including a corrector wheel, is configured so that, in the condition in which the winding stem is pulled out to a winding stem position in which a calendar correction can be made, by the corrector wheel rotating based on the rotation of the winding stem, a correction pin provided on the corrector wheel enters a corrector advance groove of the program wheel, thus enabling the program wheel to rotate. With the calendar mechanism equipped timepiece of the invention, it is possible to easily correct a date display with a compact configuration.

With the calendar mechanism equipped timepiece of the invention, it is preferable that it is configured so that the position of the rotation center of the program wheel is disposed in a position which, being on the opposite side of positions in which a first date character and a second date character are displayed through windows in the dial from the positions of the rotation centers of the time display wheels, is eccentric from the positions of the rotation centers of the time display wheels. With this configuration, it is possible to realize a calendar mechanism whose first date characters and second date characters are configured largely, and easy to see.

DETAILED DESCRIPTION OF THE PREFERRED EMBODIMENTS

Figure 1:
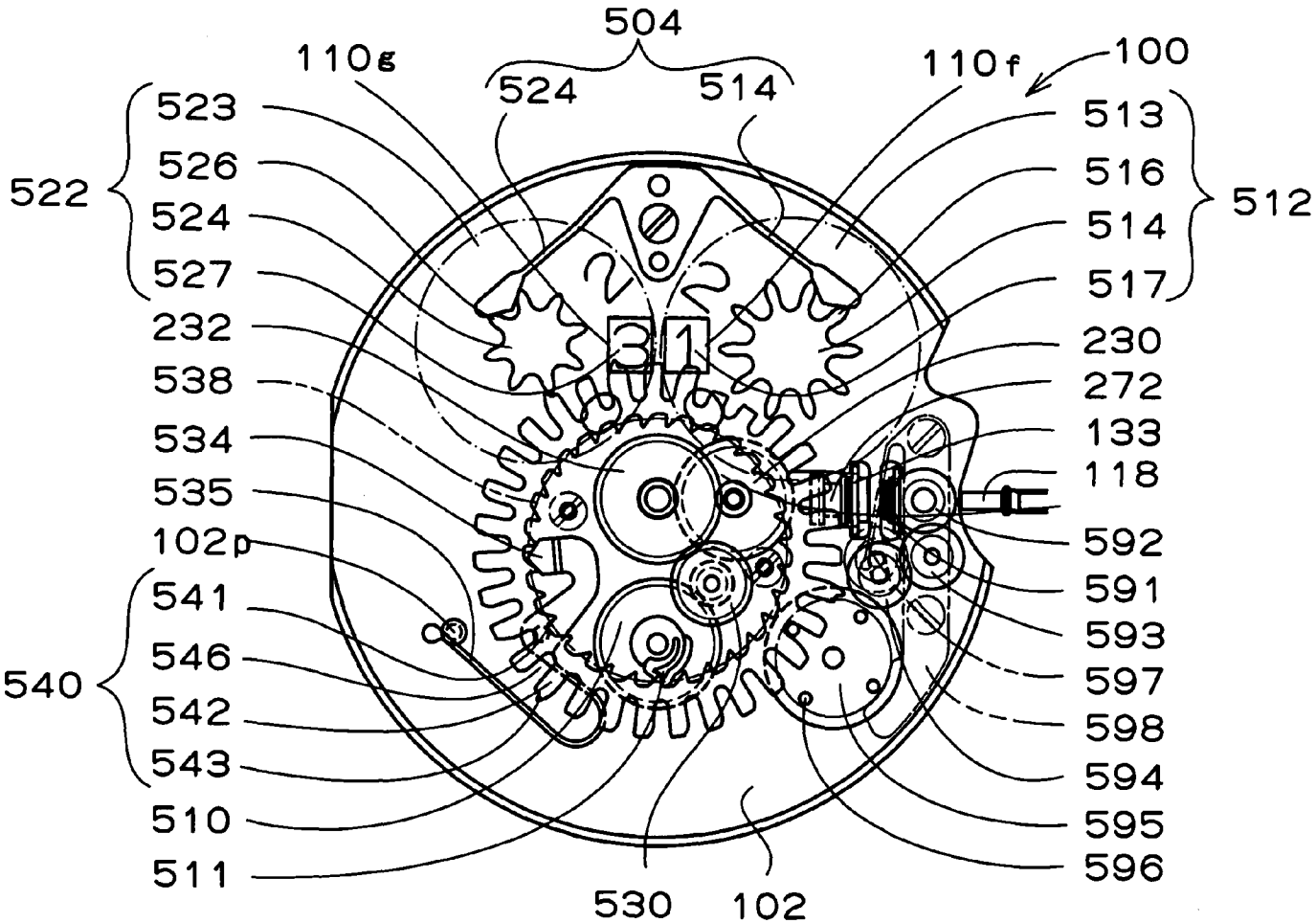
FIG. 1 is an outline plan view showing a disposition and mutual relationship of two date indicators and a program wheel, when looking at a movement from the dial side, in a first embodiment of a calendar mechanism equipped timepiece of the invention.

Hereafter, a description will be given, based on the drawings, of embodiments of a calendar mechanism equipped timepiece of the invention.

(1) Structure of First Embodiment of Calendar Mechanism Equipped Timepiece of the Invention:

Firstly, a description will be given of a first embodiment of the calendar mechanism equipped timepiece of the invention. The first embodiment of the calendar mechanism equipped timepiece of the invention is an embodiment wherein the calendar mechanism equipped timepiece is configured by an automatic winding mechanism equipped mechanical timepiece.

(1•1) Structure of Front Side of Movement:

Firstly, a description will be given of a first embodiment of a display correction mechanism equipped timepiece of the invention. The first embodiment relates to a calendar correction mechanism equipped timepiece. Referring to FIGS. 1 to 5, the calendar correction mechanism equipped timepiece of the invention includes a movement 100. The "movement" refers to a mechanical body of the timepiece including a drive portion. Also, a "complete" refers to a completed body of the timepiece wherein a dial, hands (an hour hand, a minute hand, a second hand, and the like), a crown, and the like, are mounted on the movement of the timepiece, and housed in a timepiece case (a timepiece exterior). The movement 100 includes a main plate 102 configuring the substrate of the timepiece. The "front side" of the movement 100 refers to a side, of the two sides of the main plate 102, farther from the glass of the timepiece case, that is, a "case back side". The "back side" of the movement 100 refers to a side, of the two sides of the main plate 102, nearer to the glass of the timepiece case, that is, a "dial side". The movement 100 includes a barrel and train wheel bridge 104, a center wheel bridge 105, a pallet bridge 106, and a balance bridge 107. The dial 110 is disposed on the glass side of the main plate 102. The dial 110 is mounted on the main plate 102 across a dial support 109. A winding stem 118 is mounted in the main plate 102 so as to be rotatable with respect to the main plate 102 and movable in the direction of its own axis.

A front train wheel, an escapement mechanism, a governing mechanism, an automatic winding mechanism, a manual winding mechanism, and a switching mechanism are disposed on the front side of the movement 100. Alternatively, the switching mechanism may also be disposed on the back side of the movement 100. Alternatively, it is also acceptable to dispose the manual winding mechanism on the front side of the movement 100, and omit the automatic winding mechanism. A back train wheel, a date display mechanism, and a date correction mechanism are disposed on the back side of the movement 100. When necessary, any of a day display mechanism, a day correction mechanism, a 24 hour display mechanism, a month display mechanism, a lunar age display mechanism, a mainspring winding condition display mechanism, and the like, or the like, may also be disposed on the back side of the movement 100. The front train wheel is rotatably supported on the main plate 102, barrel and train wheel bridge 104, and center wheel bridge 105. The back train wheel is rotatably supported on the main plate 102.

(1•2) Configuration of Front Train Wheel

Figure 2:
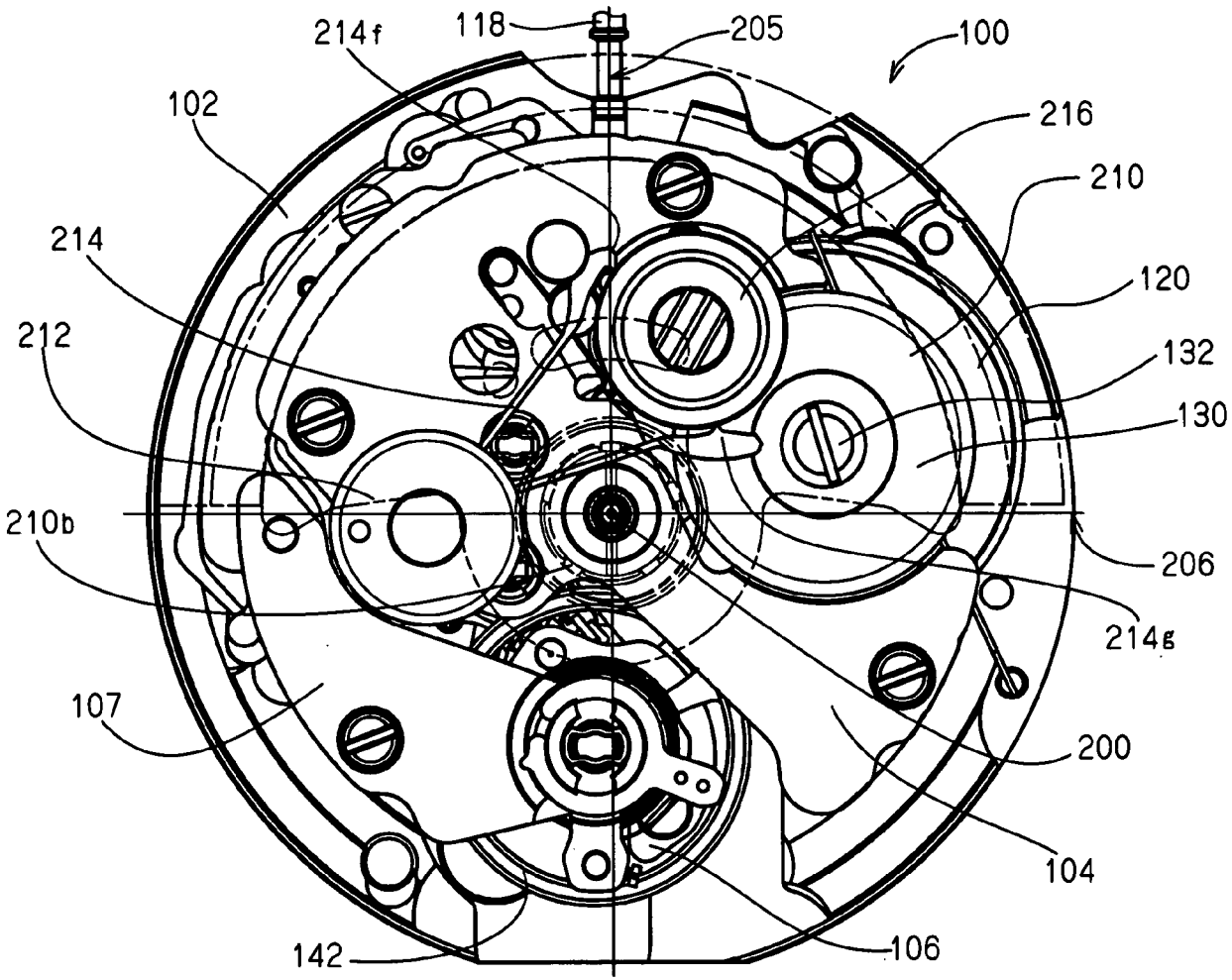
FIG. 2 is an outline plan view showing a structure when looking at the movement from the case back side in the first embodiment of the calendar mechanism equipped timepiece of the invention.
Figure 3:
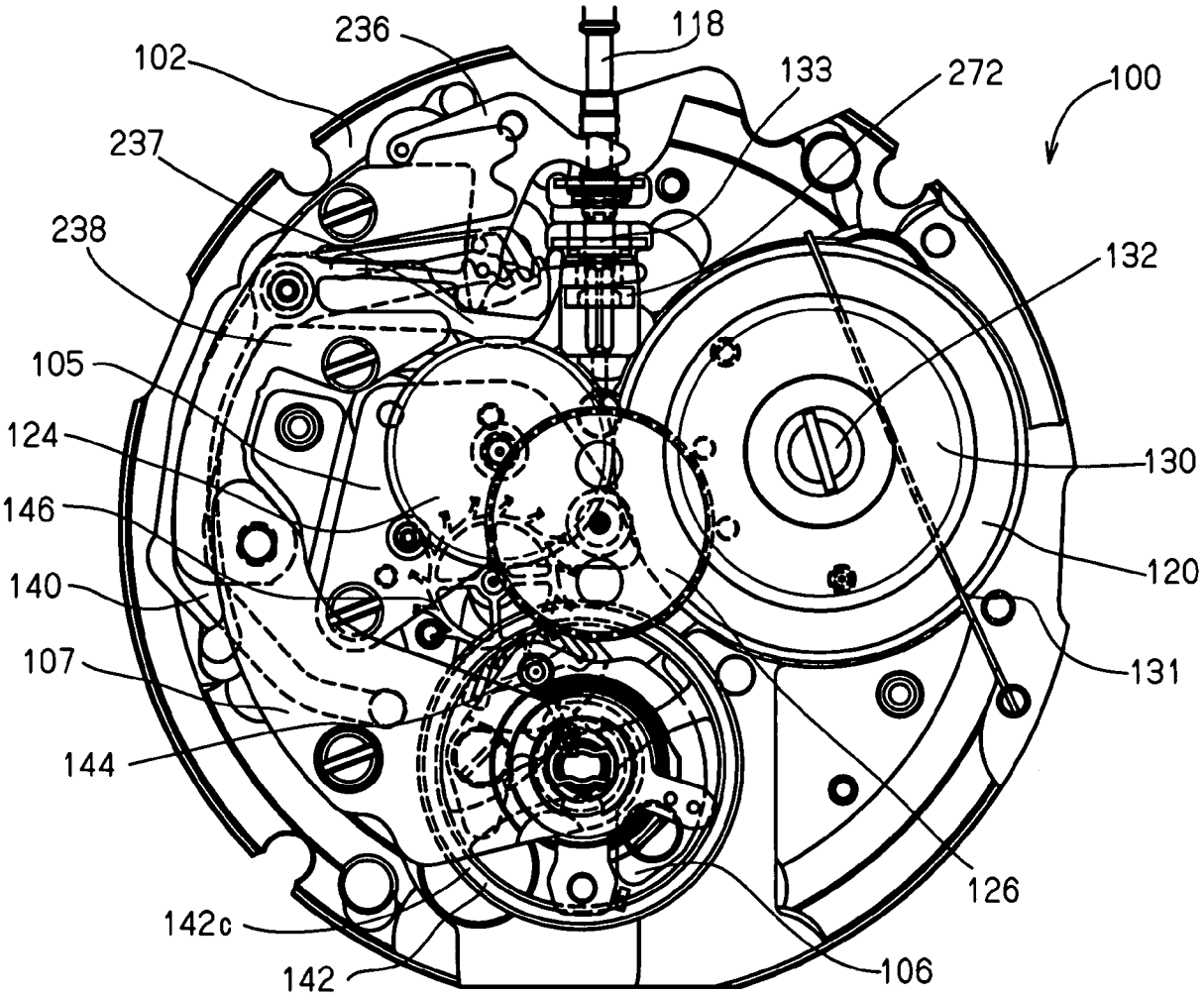
FIG. 3 is an outline plan view showing a structure when looking at the movement in a condition, in which a balance bridge, a train wheel bridge, and an automatic winding train wheel bridge are removed, from the case back side in the first embodiment of the calendar mechanism equipped timepiece of the invention.
Figure 4:
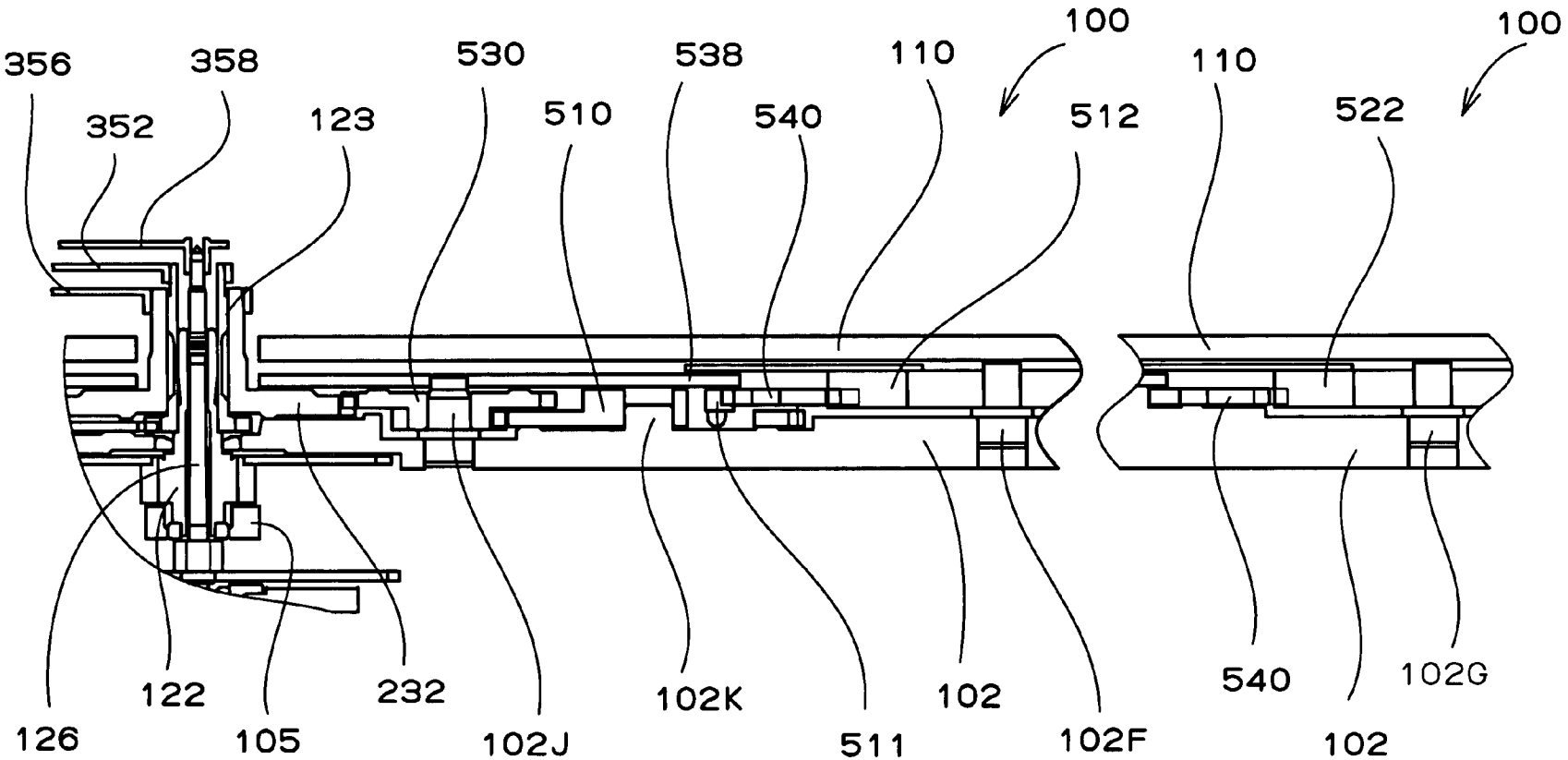
FIG. 4 is a fragmentary sectional view showing a portion with a program driving wheel and an intermediate program wheel in the first embodiment of the calendar mechanism equipped timepiece of the invention.
Figure 5:
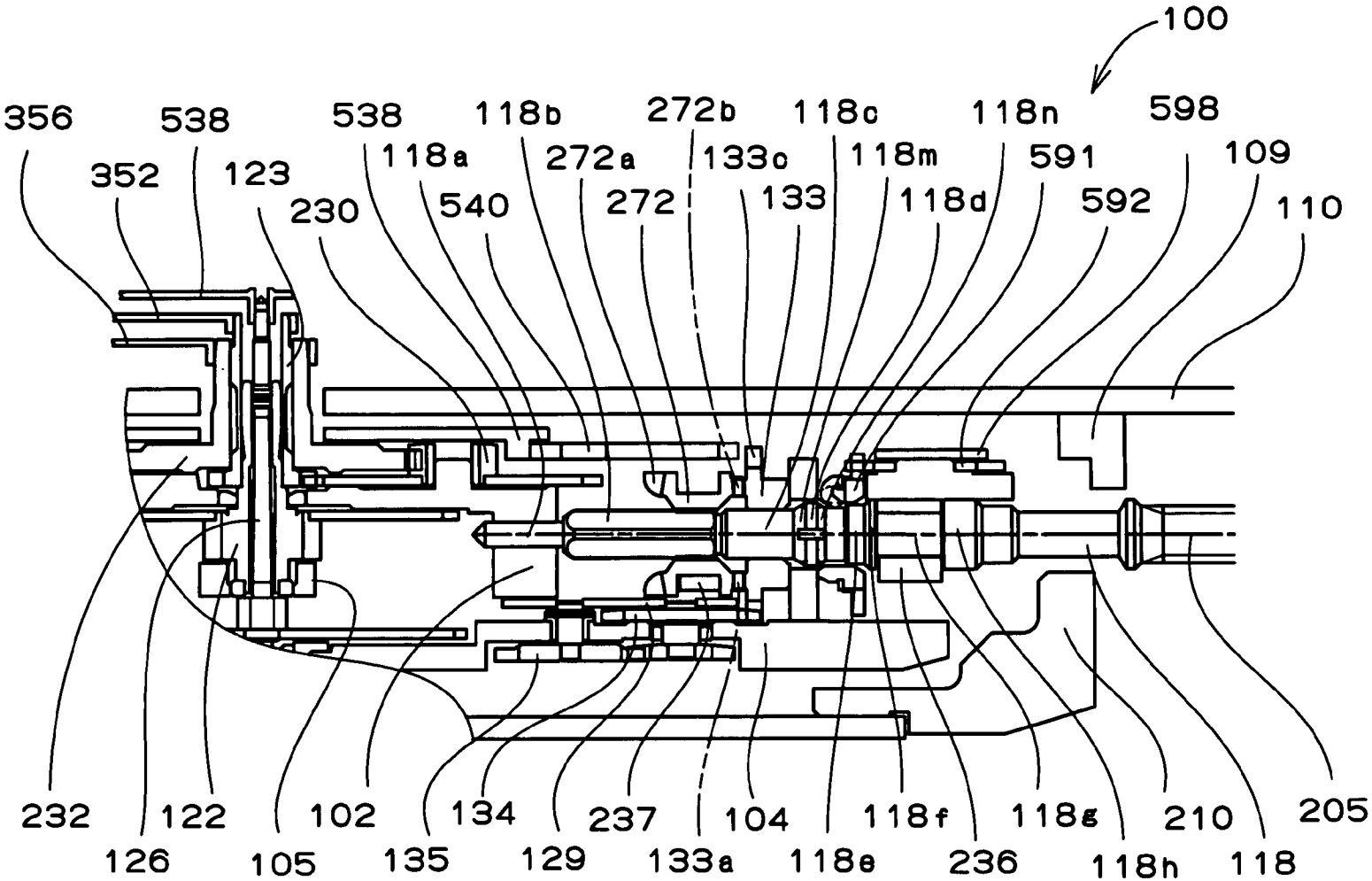
FIG. 5 is a fragmentary sectional view showing a portion with a winding stem and a minute wheel in the first embodiment of the calendar mechanism equipped timepiece of the invention.

Next, a description will be given of a configuration of the front train wheel. Referring to FIGS. 2, 3, and 5, a movement barrel 120 is rotatably supported on the barrel and train wheel bridge 104 and main plate 102. The movement barrel 120 has a mainspring (not shown). The mainspring configures the power source of the mechanical timepiece. By the mainspring being wound back (released), the barrel gear of the movement barrel 120 rotates in one direction, thus displaying time information with the hands (the hour hand, minute hand, second hand, and the like) by means of the rotation of the front train wheel and back train wheel. The rotation of the barrel gear rotating due to the power of the mainspring is controlled by a governing device and an escapement device. The governing device includes a balance with hairspring 142. The escapement device includes a pallet fork 144 and an escape wheel & pinion 146. The balance with hairspring 142 is rotatably supported on the balance bridge 107 and main plate 102. The pallet fork 144 is rotatably supported on the pallet bridge 106 and the main plate 102. The escape wheel & pinion 146 is rotatably supported on the barrel and train wheel bridge 104 and main plate 102. A configuration is such that a center wheel & pinion 122 (refer to FIG. 4) rotates once an hour by means of the rotation of the barrel wheel. The center wheel & pinion 122 is rotatably supported on the center wheel bridge 105 and main plate 102. A configuration is such that a third wheel & pinion 124 rotates by means of the rotation of the center wheel & pinion 122.

The third wheel & pinion 124 is rotatably supported on the barrel and train wheel bridge 104 and main plate 102. A configuration is such that a second wheel & pinion 126 rotates once every minute by means of the rotation of the third wheel & pinion 124. The second wheel & pinion 126 is rotatably supported on the barrel and train wheel bridge 104 and main plate 102. A configuration is such that the rotating speed of the second wheel & pinion 126 is controlled by the escape wheel & pinion 146. A configuration is such that the rotating speed of the escape wheel & pinion 146 is controlled by the pallet fork 144. A configuration is such that the oscillating movement of the pallet fork 144 is controlled by the balance with hairspring 142. The balance setting lever 140 is provided in order to set the operation of the balance with hairspring 142. That is, the balance setting lever 140 is configured so as to be able to make contact with a balance wheel 142*c* of the balance with hairspring 142 and stop the rotation of the balance wheel 142*c* in a condition in which the winding stem 118 is placed in the 2nd step. The front train wheel includes the center wheel & pinion 122, third wheel & pinion 124, and second wheel & pinion 126. A configuration is such that a minute hand 352 mounted on a cannon pinion 123 of the center wheel & pinion 122 indicates the "minute". A configuration is such that a second hand 358 mounted on the second wheel & pinion 126 indicates the "second". A configuration is such that the rotation center of the second wheel & pinion 126 and the rotation center of the center wheel & pinion 122 are in the same position.

The square hole of a ratchet wheel 130 is fitted with a square shaft provided in the upper portion (on the side on which the barrel and train wheel bridge 104 exists) of the barrel arbor of the movement barrel 120. The ratchet wheel 130 is supported by a ratchet wheel setscrew 132 so as to rotate integrally with the barrel arbor 120*c*. The ratchet wheel 130 can rotate only in a direction the same as a direction in which the movement barrel 120 rotates. A click 131 configuring a ratchet wheel rotation setting member is provided on the barrel and train wheel bridge 104 in order to set the rotation of the ratchet wheel 130 to only one direction. The ratchet wheel 130 can be prevented by the click 131 from rotating in a direction opposite to the direction in which the movement barrel 120 rotates. The manual winding mechanism includes a clutch wheel 272, a winding wheel 133, a crown wheel 134, and a crown transmission wheel (not shown). The crown wheel 134 is rotatably supported on the back surface of the barrel and train wheel bridge 104. The crown transmission wheel is rotatably supported on the front surface of the barrel and train wheel bridge 104. The crown wheel 134 and crown transmission wheel are fixed so as to rotate integrally. A ratchet sliding wheel 135 is rotatably mounted on a barrel and train wheel bridge lower spacer 129. A configuration is such that the ratchet sliding wheel 135 rotates by means of the rotation of the crown transmission wheel. The barrel and train wheel bridge lower spacer 129 is configured so as to oscillate and rotate with the central axis of the crown wheel 134 as its rotation center. A configuration is such that the winding wheel 133 rotates by means of a one direction rotation of the clutch wheel 272. A configuration is such that the crown wheel 134 and ratchet sliding wheel 135 rotate integrally by means of the rotation of the winding wheel 133. A configuration is such that the ratchet sliding wheel 135 oscillates by means of the rotation of the crown transmission wheel, and the ratchet wheel 130 rotates in the clockwise direction by means of the rotation of the ratchet sliding wheel 135. A configuration is such that it is possible to wind the mainspring by the ratchet wheel 130 rotating.

(1•3) Configuration of Automatic Winding Mechanism

Next, a description will be given of a configuration of the automatic winding mechanism. In FIG. 2, the automatic winding mechanism for winding up the mainspring is provided on the front side of the movement 100. The automatic winding mechanism includes an oscillating weight 210, a first transmission wheel 212, a pawl lever 214, and a second transmission wheel 216. The oscillating weight 210 is rotatably mounted on the barrel and train wheel bridge 104 across a ball bearing 210*b*. The first transmission wheel 212 is rotatably supported on the barrel and train wheel bridge 104 and main plate 102. The gear of the first transmission wheel 212 is configured so as to mesh with an oscillating weight pinion 210*c* of the oscillating weight 210. The hole (not shown) in the base of the pawl lever 214 is rotatably fitted with the eccentric cam portion (not shown) of the first transmission wheel 212. The pawl lever 214 has two pawl portions, that is, a pull pawl 214*f* and a push pawl 214*g*. The second transmission wheel 216 is rotatably supported on the barrel and train wheel bridge 104. The pull pawl 214*f* and push pawl 214*g* of the pawl lever 214 are configured so as to mesh with the ratchet teeth (not shown) of the second transmission wheel 216. A configuration is such that, on the oscillating weight 210 rotating, the first transmission wheel 212 rotates, thus operating the pawl lever 214. The pull pawl 214*f* of the pawl lever 214 is configured so as to be able to cause the second transmission wheel 216 to rotate only in one direction (the counterclockwise direction in FIG. 2). The push pawl 214*g* of the pawl lever 214 is configured so as to be able to cause the second transmission wheel 216 to rotate only in one direction (the counterclockwise direction in FIG. 2). Consequently, a configuration is such that, on the oscillating weight 210 rotating, the pawl lever 214 operates, and the ratchet wheel 130 rotates in the clockwise direction based on the rotation of the second transmission wheel 216. As a result of this, on the oscillating weight 210 rotating, the mainspring can be wound up by means of the operation of the automatic winding mechanism.

(1•4) Configuration of Back Train Wheel

Next, a description will be given of a configuration of the back train wheel. Referring to FIG. 5, the back train wheel includes a minute wheel 230 and an hour wheel 232. The minute wheel 230 is rotatably supported on the main plate 102. A configuration is such that the minute wheel 230 rotates by means of the rotation of the center wheel & pinion 122. A configuration is such that the hour wheel 232 rotates once every 24 hours by means of the rotation of the minute wheel 230. An hour hand 356 mounted on the hour wheel 232 indicates the "hour". A configuration is such that the rotation center of the hour wheel 232 and the rotation center of the center wheel & pinion 122 are in the same position. It is preferable that the rotation center of the minute wheel 230 is disposed on a central axis 205 of the winding stem 118.

(1•5) Configuration of Switching Mechanism

Next, a description will be given of a configuration of the switching mechanism. The timepiece of the invention is provided with the switching mechanism and a time setting mechanism in order to set the time of the timepiece. Referring to FIGS. 3 and 5, the switching mechanism is configured so as to include a setting lever 236, a yoke 237, and a yoke holder 238. The setting lever 236 and yoke 237 are operably supported on the main plate 102. The yoke holder 238 is fixed to the main plate 102. The time setting mechanism includes the winding stem 118 and clutch wheel 272. The winding stem 118 includes a leading end shaft 118*a*, a square shaft 118*b*, a winding wheel guide 118*c*, a corrector transmission portion 118*d*, a first calendar corrector wheel guide 118*e*, a setting lever inner wall 118*f*, a setting lever receiver 118*g*, and a setting lever outer wall 118*h*, which are formed in order from the leading end toward the outer portion. It is preferable that an interior slope 118*m* is provided in a portion of the corrector transmission portion 118*d* of the winding stem 118 in the inward direction of the movement 100. It is preferable that an exterior slope 118*n* is provided in a portion of the corrector transmission portion 118*d* of the winding stem 118 in the outward direction of the movement 100. The leading end shaft 118*a* of the winding stem 118 is rotatably supported in the winding stem leading end hole of the main plate 102.

The square hole of the clutch wheel 272 is fitted with the square shaft 118*b* of the winding stem 118. The winding stem contact portion of the setting lever 236 is positioned between the setting lever inner wall 118*f* and setting lever outer wall 118*g* of the winding stem 118. A position of the winding stem 118 in a direction following the central axis of the winding stem 118 is fixed by the switching device (the setting lever, yoke holder, and the like). A position of the clutch wheel 272 in a direction following the central axis of the winding stem 118 is fixed by the switching device (the setting lever, yoke, yoke holder, and the like). The clutch wheel 272 includes A teeth 272*a* positioned nearer to the center of the movement 100 and B teeth 272*b* positioned nearer to the external portion of the movement 100. The B teeth 272*b* of the clutch wheel 272 are configured of ratchet teeth. The central hole of the winding wheel 133 is rotatably fitted with the winding wheel guide 118*c* of the winding stem 118. The winding wheel 133 includes a small winding gear 133*a*, configured so as to be able to mesh with the B teeth 272*b* of the clutch wheel 272, and a large winding gear 133*c* configured so as to be able to mesh with the gear of the crown wheel 134. The small winding gear 133*a* is configured of a ratchet gear. The operation of the balance setting lever 140 is controlled by the rotation of the setting lever 236.

The A teeth 272*a* of the clutch wheel 272 are configured so as not to mesh with the gear of the minute wheel 230 in a condition in which the winding stem 118 is placed in the 0th step, and in a condition in which the winding stem 118 is placed in the 1st step. The B teeth 272*b* of the clutch wheel 272 are configured so as to mesh with the small gear 133*a* of the winding wheel 133 in the condition in which the winding stem 118 is placed in the 0th step. The A teeth 272*a* of the clutch wheel 272 are configured so as to mesh with the gear of the minute wheel 230 in the condition in which the winding stem 118 is placed in the 2nd step. The B teeth 272*b* of the clutch wheel 272 are configured so as not to mesh with the small gear 133*a* of the winding wheel 133 in the condition in which the winding stem 118 is placed in the 2nd step. A configuration is such that, on the winding stem 118 being rotated in one direction in the condition in which the winding stem 118 is placed in the 0th step, the clutch wheel 272 rotates together with the winding stem 118, and the ratchet wheel 130 rotates by means of the rotation of the winding wheel 133, crown wheel 134, and crown transmission wheel 135, thus enabling the mainspring to be wound up. A configuration is such that, on the winding stem 118 being rotated in the other direction in the condition in which the winding stem 118 is placed in the 0th step, the clutch wheel 272 rotates together with the winding stem 118, but the winding wheel 133 does not rotate.

(1•6) Configuration of Date Indicator Advance Mechanism:

(1•6•1) Overall Configuration of Date Indicator Advance Mechanism:

Hereafter, a description will be given of a configuration of a date indicator advance mechanism. Referring to FIGS. 1, 4, and 5, a date advance mechanism includes an intermediate program wheel 530, a program driving wheel 510, a program advance pawl 511, a program wheel 540, and a program wheel jumper 534. The intermediate program wheel 530 is rotatably mounted on an intermediate program wheel shaft 102J provided on the main plate 102. The intermediate program wheel 530 includes a gear having teeth of a large outer diameter and a pinion having teeth of a small outer diameter.

It is preferable that the position of the rotation center of the program wheel 540 is disposed in a position which, being on the opposite side of positions in which a first date character 517 and a second date character 527 are displayed through windows in the dial 110 from the positions of the rotation centers of the cannon pinion 123 of the center wheel & pinion 122 and the second wheel & pinion 126 which configure time display wheels, is eccentric from the positions of the rotation centers of the time display wheels 123 and 126.

The program driving wheel 510 is rotatably mounted on a program driving wheel shaft 102K provided on the main plate 102. It is preferable that the program advance pawl 511 is formed integrally with the program driving wheel 510 across a spring. A program wheel holder 538 is disposed between the main plate 102 and dial 110. The program wheel holder 538 rotatably supports the hour wheel 232, intermediate program wheel 530, program driving wheel 510, and program wheel 540 on the main plate 102. The intermediate program wheel 530, program driving wheel 510, and program wheel 540 are disposed between the main plate 102 and program wheel holder 538.

The gear of the hour wheel 232 meshes with the gear of the intermediate program wheel 530. The pinion of the intermediate program wheel 530 meshes with the gear of the program driving wheel 510. A configuration is such that, by the hour wheel 232 rotating, the program driving wheel 510 rotates once every 24 hours by means of the rotation of the intermediate program wheel 530. The program advance pawl 511 is configured so as to rotate integrally based on the rotation of the program driving wheel 510. It is preferable that the rotation center of the program driving wheel 510 is disposed between the "5 o'clock direction" and "7 o'clock direction" of the dial. With this configuration, it is possible to reduce the area of the calendar mechanism equipped timepiece occupied by a drive mechanism which drives a first date indicator 512 and a second date indicator 522.

Figure 6:
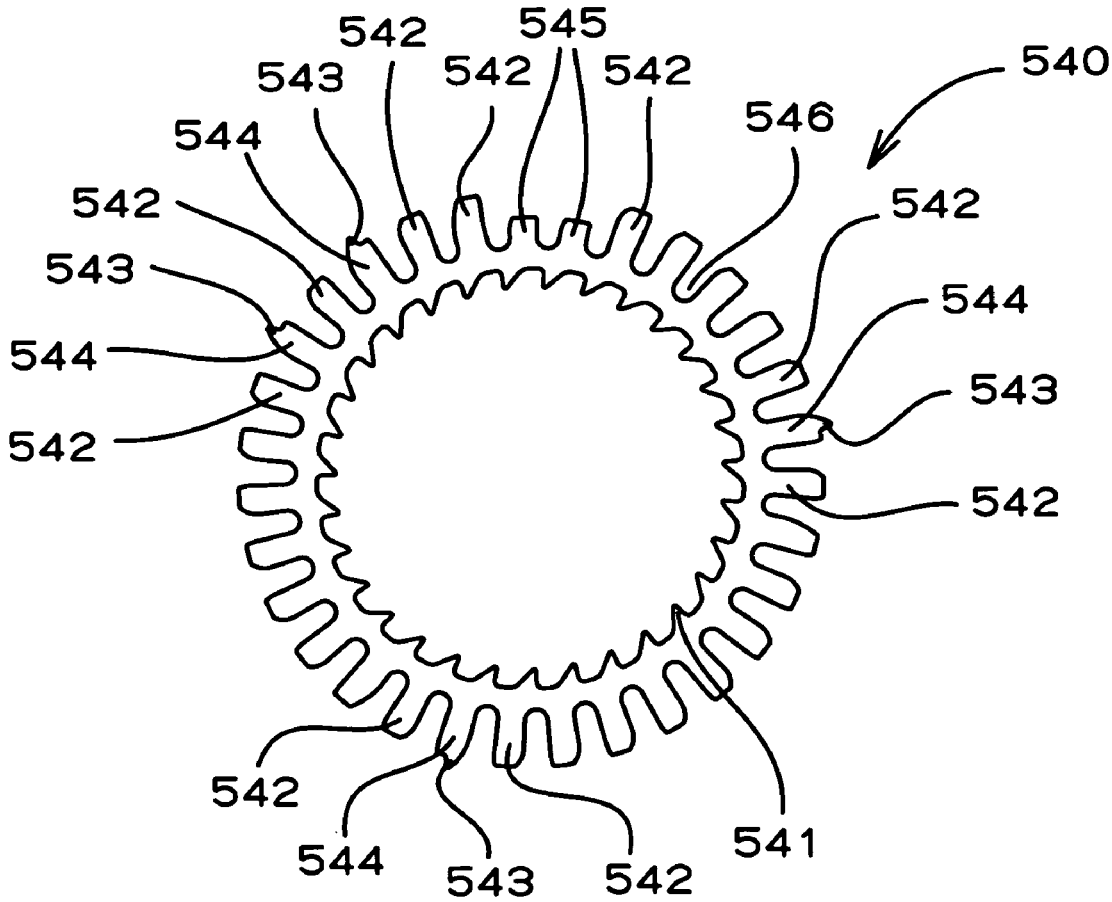
FIG. 6 is a plan view showing the program wheel in the first embodiment of the calendar mechanism equipped timepiece of the invention.

(1•6•2) Configuration of Program Wheel:

Referring to FIGS. 1 and 6, the program wheel 540 includes program wheel teeth 541 configured so as to be advanced by means of the rotation of the program advance pawl 511, first date indicator advance teeth 542 configured so as to advance the first date indicator 512, second date indicator advance teeth 544, which can advance the first date indicator 512 and have provided at the leading end thereof second date indicator advance fingers 543 for advancing the second date indicator 522, and correction teeth 545 configured so as to be unable to advance the first date indicator 512 and unable to advance the second date indicator 522. The first date indicator advance teeth 542, second date indicator advance teeth 544, and correction teeth 545 are disposed on the outer side of the program wheel 540. The height of the second date indicator advance teeth 544 is greater than the height of the first date indicator advance teeth 542. The height of the first date indicator teeth 542 is greater than the height of the correction teeth 545. The number of first date indicator advance teeth 542 provided is 25. The number of second date indicator advance teeth 544 provided is four. The number of correction teeth 545 provided is two. Consequently, the total number of external teeth (teeth disposed on the outer side) provided on the program wheel 540 is 31. It is preferable that the program wheel 540 is configured in a kind of shape which is in one plane.

Each of corrector advance grooves 546 is provided between two adjacent teeth. That is, the corrector advance grooves 546 are provided respectively between one correction tooth 545 and the other correction tooth 545 adjacent thereto, between one correction tooth 545 and the first date indicator advance tooth 542 adjacent thereto, between one first date indicator advance tooth 542 and another first date indicator advance tooth 542 adjacent thereto, and between the other first date indicator advance tooth 542 and one second date indicator advance tooth 544 adjacent thereto. The number of corrector advance grooves 546 provided is 31.

The program wheel 540 has 31 teeth configured of the external teeth. As seen in the clockwise direction, the program wheel 540 includes the two correction teeth 545, the next five first date indicator advance teeth 542, the next one second date indicator advance tooth 544, the next nine first date indicator advance teeth 542, the next one second date indicator advance tooth 544, the next eight first date indicator advance teeth 542, the next one second date indicator advance tooth 544, the next one first date indicator advance tooth 542, the next one second date indicator advance tooth 544, and the next two first date indicator advance teeth 542. The adjacent teeth are formed so as to have regular angular intervals. The angular interval of two adjacent teeth is 360/31 degrees. The angular interval between one correction tooth 545 and the other correction tooth 545 adjacent thereto is 360/31 degrees. The angular interval between one correction tooth 545 and the first date indicator advance tooth adjacent thereto is 360/31 degrees. The angular interval between one first date indicator advance tooth 542 and another first date indicator advance tooth 542 adjacent thereto is 360/31 degrees. The angular interval between the other first date indicator advance tooth 542 and one second date indicator advance tooth 544 adjacent thereto is 360/31 degrees.

The program wheel 540 has 31 program wheel teeth 541 formed so as to have regular angular intervals. The program wheel teeth 541 for advancing the program wheel 540 are provided on the program wheel 540 as internal teeth (teeth disposed on the inner side). The angular interval of the program wheel teeth 541 is 360/31 degrees.

A program wheel jumper 534 for setting the rotation direction position of the program wheel 540 is mounted on the main plate 102. The program wheel jumper 534 includes a program wheel jumper spring 535 and a setting portion for setting the program wheel teeth 541. The setting portion of the program wheel jumper 534 is configured so as to set two of the program wheel teeth 541 of the program wheel 540. The vicinity of the leading end of the program wheel jumper spring 535 is positioned by a program wheel jumper pin 102P provided on the main plate 102.

(1•6•3) Configurations of First Date Indicator and Second Date Indicator:

Referring to FIGS. 1 and 4, the first date indicator 512 is rotatably mounted on a first date indicator shaft 102F provided in the main plate 102. A date indicator jumper 504 is mounted on the main plate 102. The date indicator jumper 504 includes a first date indicator jumper 514 for setting the rotation direction position of the first date indicator 512, and a second date indicator jumper 524 for setting the rotation direction position of the second date indicator 522. In the embodiment, a description will be given of a structure wherein the first date indicator jumper 514 and second date indicator jumper 524 are integrally formed, but it is also possible to configure the first date indicator jumper 514 and second date indicator jumper 524 as separate parts. The first date indicator jumper 514 for setting the rotation direction position of the first date indicator 512 includes a spring and a setting portion provided at the leading end of the spring. The setting portion of the first date indicator jumper 514 is configured so as to set two of first date indicator teeth 516 of the first date indicator 512.

The second date indicator 522 is rotatably mounted on a second date indicator shaft 102G provided in the main plate 102. The second date indicator jumper 524 includes a spring and a setting portion provided at the leading end of the spring. The setting portion of the second date indicator jumper 524 is configured so as to set two of teeth 526 of the second date indicator 522.

Referring to FIG. 1, it is preferable that the rotation center of the first date indicator 512 is disposed between the "1 o'clock direction" and "2 o'clock direction" of the dial. It is preferable that the rotation center of the second date indicator 522 is disposed between the "10 o'clock direction" and "11 o'clock direction" of the dial. With this configuration, it is possible to realize a calendar mechanism equipped timepiece whose calendar display is large and easy to see.

It is preferable that the perimeter of the first date indicator 512 and the perimeter of the second date indicator 522 are positioned in proximity to each other. A configuration is such that it is possible, with one of first date characters provided on the first date indicator 512 and one of second date characters provided on the second date indicator 522, to display information relating to the date, such as "01" to "31", through date windows in the dial 110.

Figure 23:
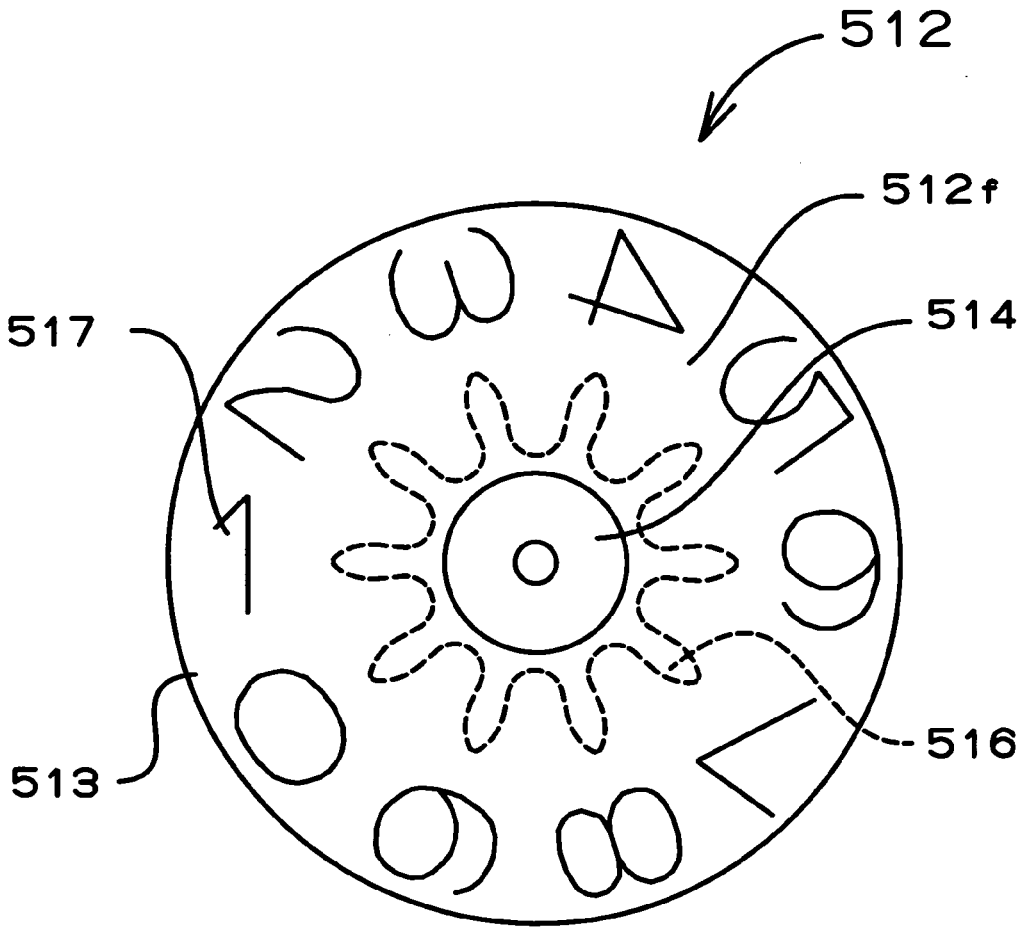
FIG. 23 is a plan view showing the first date indicator in the first embodiment of the calendar mechanism equipped timepiece of the invention.

Referring to FIG. 23, the first date indicator 512 has a first date plate 513 and a first date star 514 including ten first date indicator teeth 516 formed so as to have regular angular intervals. A first date character display surface 512*f* is provided on the upper surface of the first date plate 513. The first date characters 517 formed of ten numbers are provided on the first date character display surface 512*f*. The first date characters 517 are circumferentially disposed in the order of "0", "1", "2", "3", "4", "5", "6", "7", "8", and "9". The first date characters 517 are provided in order to display the ones column of the date. The ten numbers configuring the first date characters 517 are disposed on the first date character display surface 512*f* at regular angular intervals, that is, at intervals of (360/10) degrees.

Figure 24:
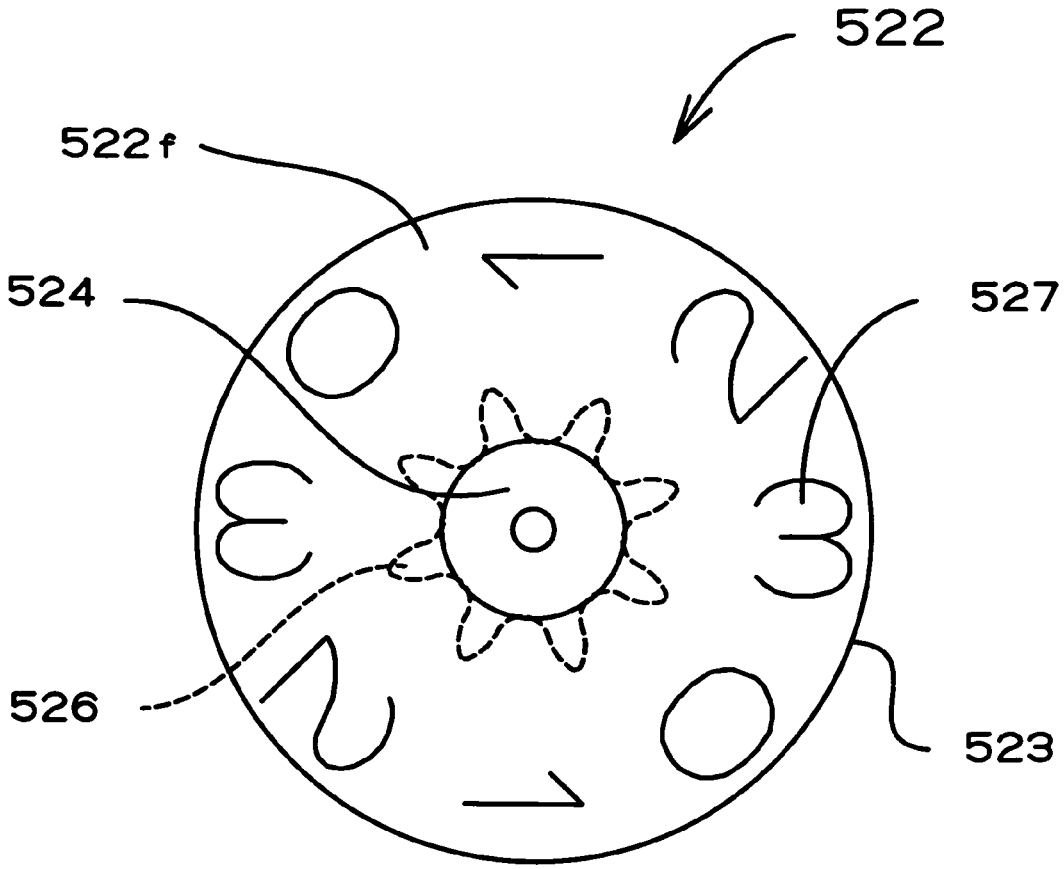
FIG. 24 is a plan view showing the second date indicator in the first embodiment of the calendar mechanism equipped timepiece of the invention.

Referring to FIG. 24, the second date indicator 522 has a second date plate 523 and a second date star 524 including eight second date indicator teeth 526 formed so as to have regular angular intervals. A second date character display surface 522*f* is provided on the upper surface of the second date plate 523. The second date characters 527 formed of eight numbers are provided on the second date character display surface 522*f*. The second date characters 527 are circumferentially disposed in the order of "0", "1", "2", "3", "0", "1", "2", and "3". The second date characters 527 are provided in order to display the tenths column of the date. The eight numbers configuring the second date characters 527 are disposed on the second date character display surface 522*f* at regular angular intervals, that is, at intervals of (360/8) degrees.

Each date plate can be formed from a metal, such as brass or aluminum, or plastic, such as polyacetal. Each date character can be formed by printing or the like. It is preferable that the outer diameter of the first date indicator 512 is formed with a dimension equal to that of the outer diameter of the second date indicator 522. It is preferable that the size of the individual first date characters 517 and the size of the individual second date characters 527 are formed equal in dimension. With this configuration, it is possible to realize a calendar mechanism whose characters are large and easy to see.

Figure 22:
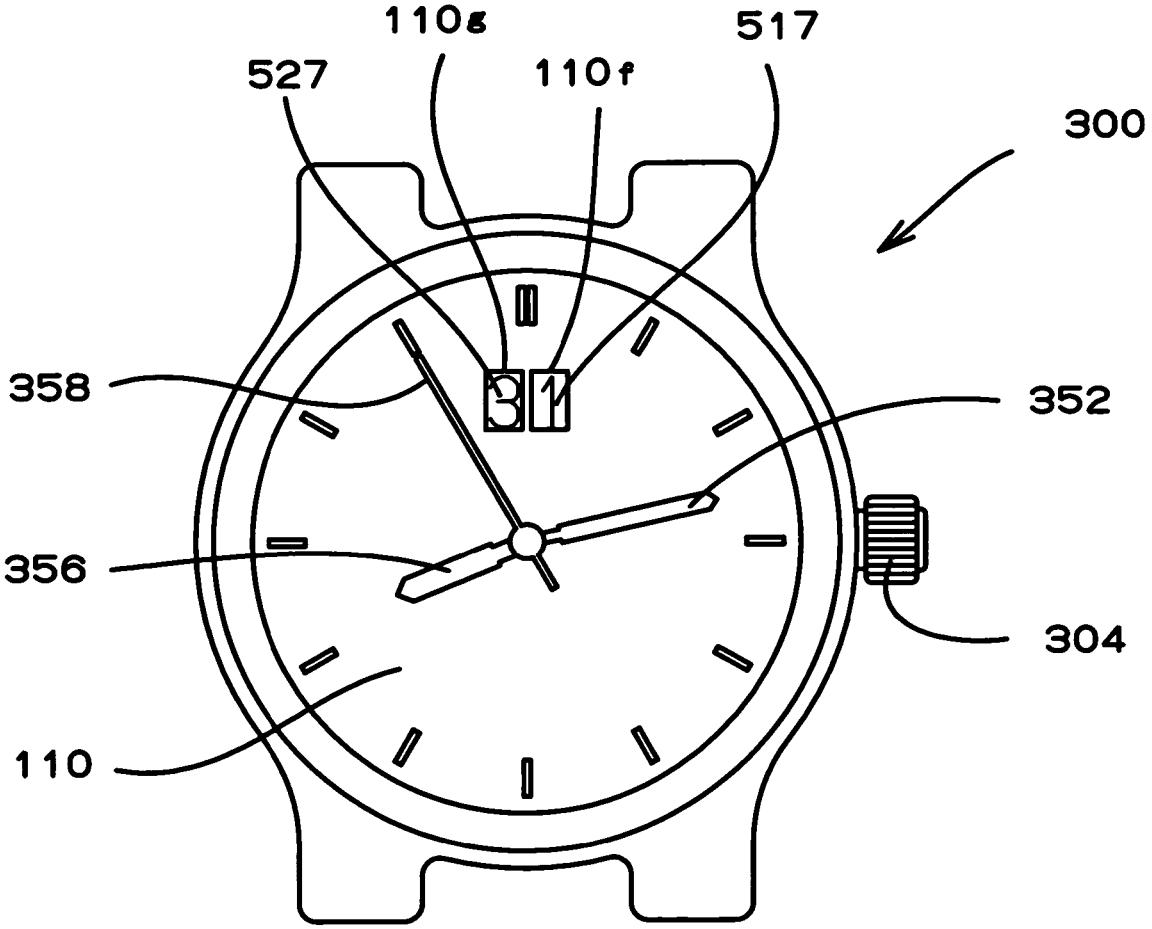
FIG. 22 is a plan view showing a complete in a condition in which the "31st" is displayed with a configuration wherein date windows are disposed in the 12 o'clock direction of the dial, in the first embodiment of the calendar mechanism equipped timepiece of the invention.

Referring to FIG. 22, it shows the complete 300 of the calendar mechanism equipped timepiece of the invention. The complete 300 includes a timepiece case 302, the crown 304, and the dial 110. FIG. 22 shows a condition of the calendar mechanism equipped timepiece of the invention in which the date windows are provided in the 12 o'clock direction position of the dial 110, and the first date indicator 512 displays "3", and the second date indicator 522 displays "1", through the date windows, thus displaying the fact that the date is the "31st". In the condition of FIG. 22, "1" of the first date characters 517 is disposed in a first date window 110*f* provided in the dial 110, and "3" of the second date characters 527 is disposed in a second date window 110*g* provided in the dial 110. The hour hand 356 mounted on the hour wheel 232 indicates the "hour". The minute hand 352 mounted on the cannon pinion 123 of the center wheel & pinion 122 indicates the "minute". The second hand 358 mounted on the second wheel & pinion 126 indicates the "second". Alternatively, as a modification example, a configuration is also possible wherein a position of the second date indicator 522 in which the number "0" is to be provided is made a "blank" portion (that is, a plain portion in which no number is provided) instead of providing the number "0". With this configuration, it is possible to realize a calendar mechanism equipped timepiece whose calendar display is large and easy to see.

Referring to FIGS. 1 and 4, by the hour wheel 232 rotating, the program driving wheel 510 rotates by means of the rotation of the intermediate program wheel 530, and the program advance pawl 511 causes the program wheel 540 to rotate one tooth in the clockwise direction once a day. By the program wheel 540 rotating, the first date indicator advance teeth 542 and second date indicator advance teeth 544 cause the first date indicator 512 to rotate one tooth in the counterclockwise direction, thus enabling a first date character 517 of the first date indicator 512 disposed in the first date window 110*f* to be changed to a next number. The one tooth's worth of rotation of the first date indicator 512 is set by the first date indicator jumper 514.

By the program wheel 540 rotating, the second date indicator advance fingers 543 cause the second date indicator 522 to rotate one tooth in the counterclockwise direction, in principle, once every ten days and at the end of every month, thus enabling a second date character 527 disposed below the second date window 110*g* to be changed to a next number. The one tooth's worth of rotation of the second date indicator 522 is set by the second date indicator jumper 524. The heretofore described kind of date advance operation is configured so as to be completed when the hour hand 356 and minute hand 352 indicate 12 hours 00 minutes.

(1•6•4) Specific Design Examples of First Date Indicator and Second Date Indicator:

In the embodiment of the calendar mechanism equipped timepiece of the invention, specific design examples of the first date indicator and second date indicator are described below.

Outer diameter of first date indicator teeth . . . diameter 5.73 mm:

Outer diameter of second date indicator teeth . . . diameter 4.26 mm:

Program Wheel:

Outer diameter of first date indicator advance fingers . . . radius 7.4 mm:

Outer diameter of second date indicator advance fingers . . . radius 7.7 mm:

Correction teeth . . . radius 6.7 mm:

Distance of center between program wheel and first date indicator . . . 9.57 mm:

Distance of center between program wheel and second date indicator . . . 9.57 mm:

(1•7) Operation of Normal Hand Movement

Next, a description will be given of an operation of the normal hand movement of the calendar mechanism equipped timepiece. Referring to FIGS. 3, 4, 5, and 25, the mainspring (not shown) mounted on the movement barrel 120 configures the power source of the timepiece. By the mainspring being wound back (released), the barrel wheel of the movement barrel 120 rotates in one direction, and the time information is displayed with the hands (the hour hand, minute hand, second hand, and the like) by means of the rotation of the front train wheel and back train wheel. The rotation of the barrel wheel rotating by means of the power of the mainspring is controlled by the governing device and escapement device. The governing device includes the balance with hairspring 142. The escapement device includes the pallet fork 144 and escape wheel & pinion 146. The center wheel & pinion 122 rotates by means of the rotation of the barrel wheel. The third wheel & pinion 124 rotates by means of the rotation of the center wheel & pinion 122. The second wheel & pinion 126 rotates once a minute by means of the rotation of the third wheel & pinion 124. The minute hand 352 mounted on the cannon pinion 123 of the center wheel & pinion 122 indicates the "minute". The second hand 358 mounted on the second wheel & pinion 126 indicates the "second". A configuration is such that the rotation center of the second wheel & pinion 126 and the rotation center of the center wheel & pinion 122 are in the same position. The minute wheel 230 rotates by means of the rotation of the center wheel & pinion 122. The hour wheel 232 is configured so as to rotate once every 12 hours by means of the rotation of the minute wheel 230. The hour hand 356 mounted on the hour wheel 232 indicates the "hour".

(1•8) Hand Setting Operation

Next, a description will be given of an operation in a case of carrying out a hand setting in the calendar mechanism equipped timepiece of the invention. Referring to FIGS. 1 and 5, on the winding stem 118 being pulled out to the 2nd step from the condition shown in the drawings, the A teeth 272*a* of the clutch wheel 272 mesh with the teeth of the minute wheel 230. In this condition, the clutch wheel 272 rotates based on the rotation of the winding stem 118. In the condition in which the winding stem 118 is placed in the 2nd step, on the winding stem 118 being rotated in the condition in which the winding stem 118 is pulled out to the 2nd step, the minute wheel 230 rotates based on the rotation of the clutch wheel 272. When the winding stem 118 is in the 2nd step, by rotating the winding stem 118, it is possible to rotate the hour wheel 232 by means of the rotation of the minute wheel 230, and correct the display details of the "hour" indicated by the hour hand 356 mounted on the hour wheel 232, and at the same time, by rotating the cannon pinion 123, it is possible to correct the display details of the "minute" indicated by the minute hand 352 mounted on the cannon pinion 123.

(1•9) Calendar Advance Operation:

Next, a description will be given of a calendar advance operation of the calendar mechanism equipped timepiece of the invention.

Figure 7:
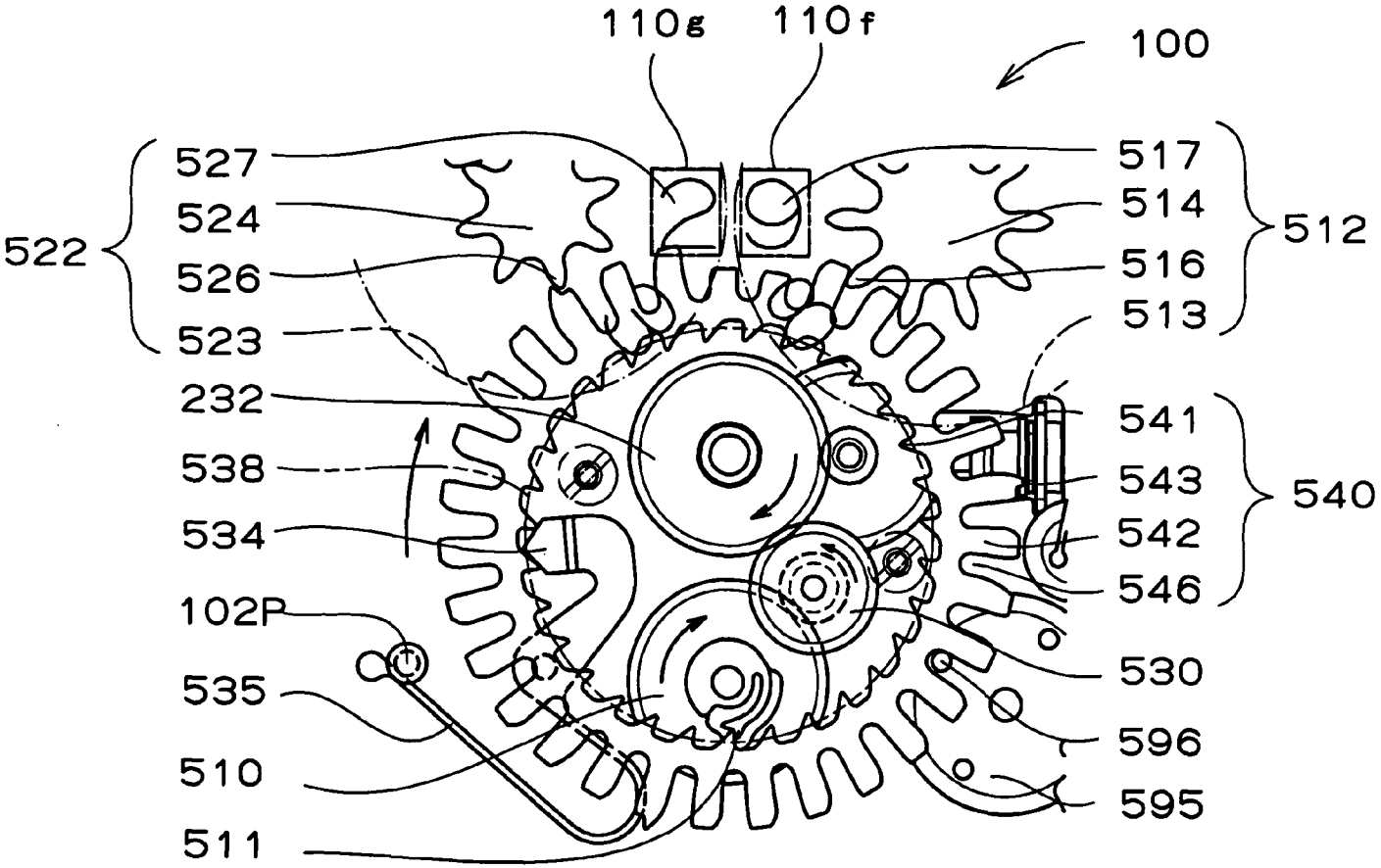
FIG. 7 is a fragmentary plan view (1) showing a structure of a date advance mechanism in a condition in which the date changes from the 29th to the 30th in the embodiment of the calendar mechanism equipped timepiece of the invention.

(1•9•1) Operation of Changing from "29th" to "30th":

Referring to FIG. 7, the condition shown in FIG. 7 is a condition in which the center position between the first date window 110*f* and second date window 110*g* is disposed in the 12 o'clock direction position of the dial 110, and the second date indicator 522 displays "2" through the second date window 110*g*, while the first date indicator 512 displays "9", thus displaying the fact that the date is the "29th".

Figure 25:
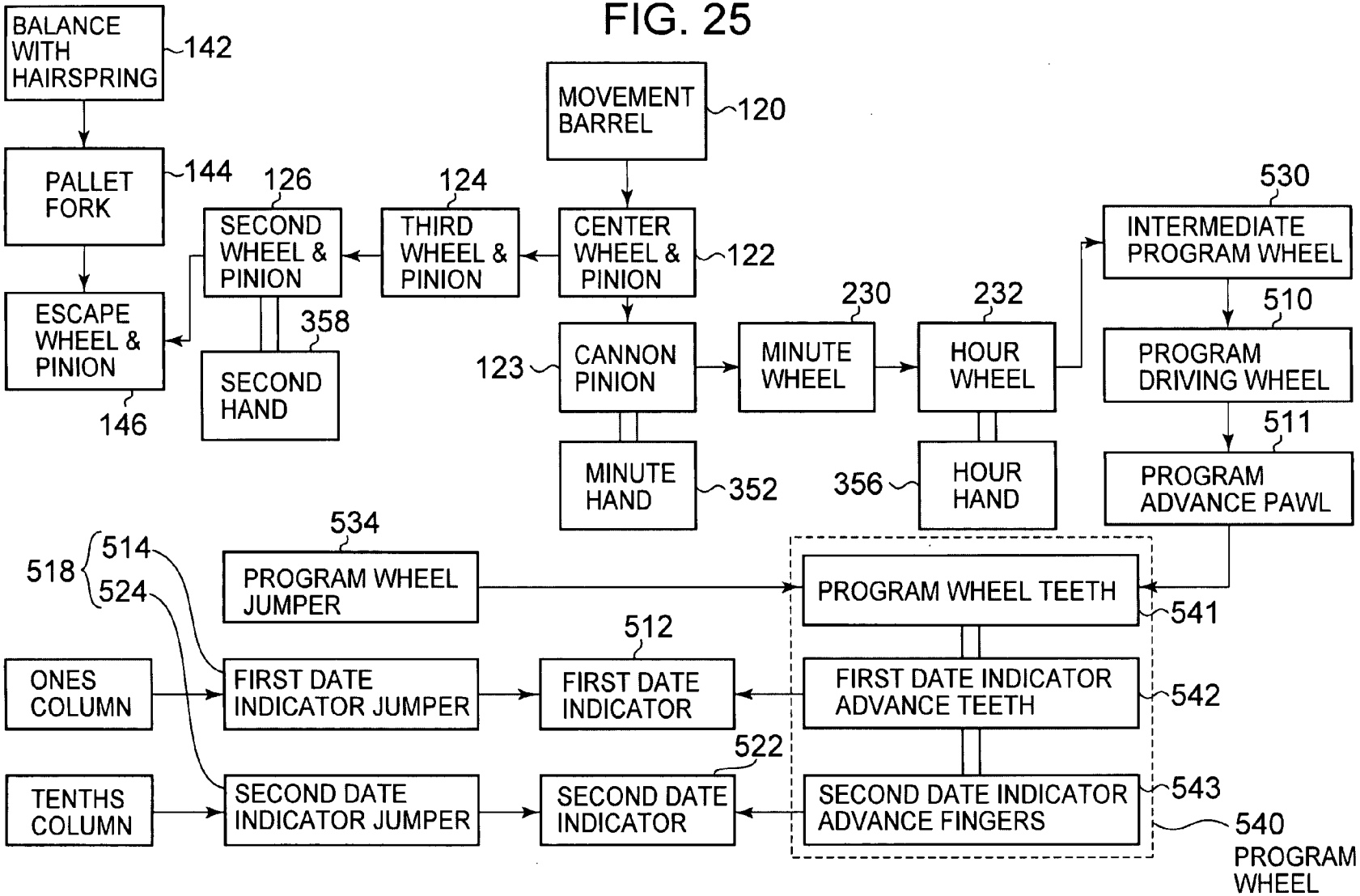
FIG. 25 is a block diagram showing the drive mechanism, a front train wheel, a calendar mechanism, and the like, in the first embodiment of the calendar mechanism equipped timepiece of the invention.

Referring to FIGS. 1, 7, and 25, by the hour wheel 232 rotating in the clockwise direction, the intermediate program wheel 530 rotates in the counterclockwise direction, and the program driving wheel 510 rotates once every 24 hours in the clockwise direction. The program advance pawl 511 rotates integrally based on the rotation of the program driving wheel 510. The program wheel teeth 541 of the program wheel 540 are advanced one step in the clockwise direction by means of the rotation of the program advance pawl 511.

Figure 8:
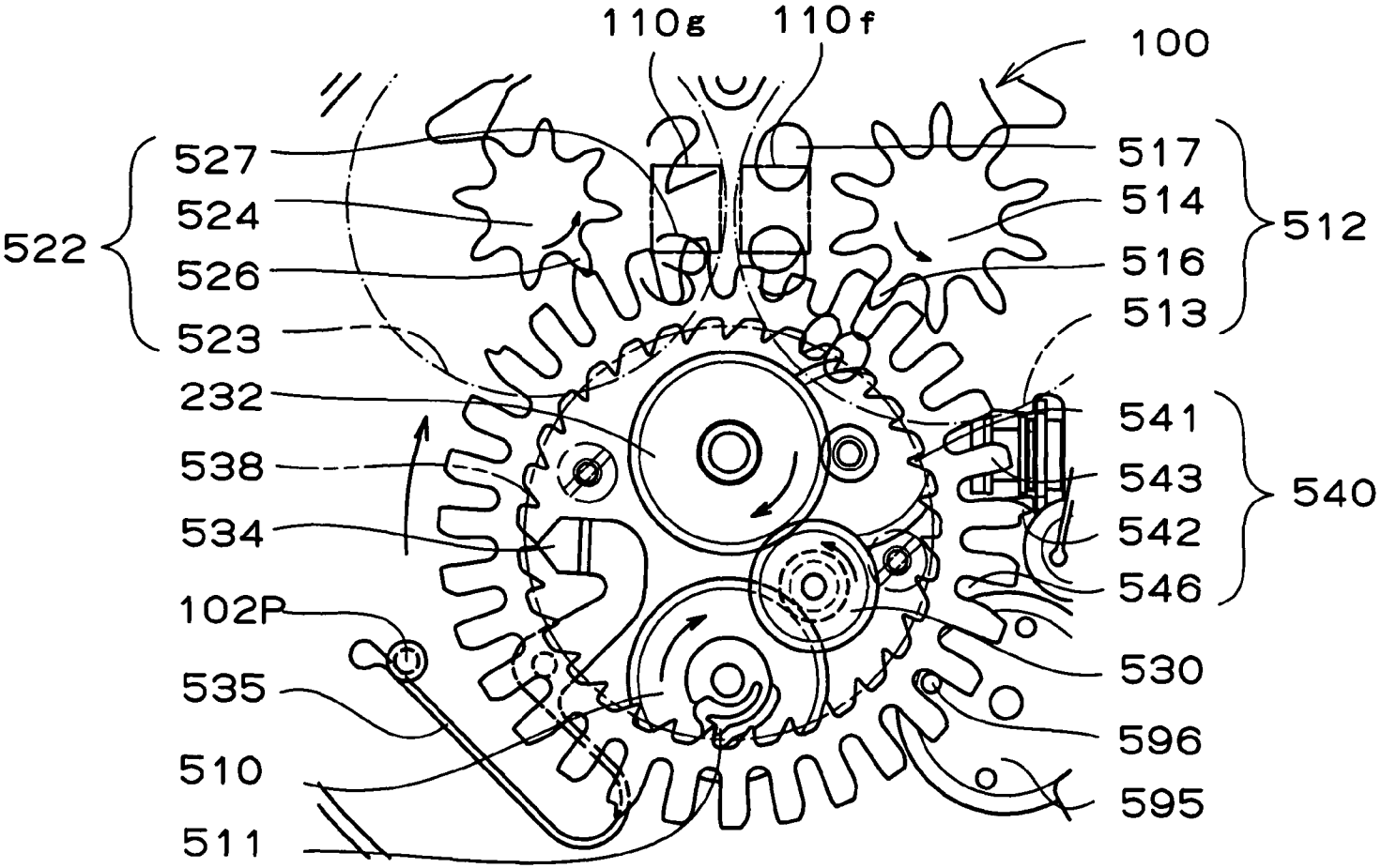
FIG. 8 is a fragmentary plan view (2) showing a structure of the date advance mechanism in the condition in which the date changes from the 29th to the 30th in the embodiment of the calendar mechanism equipped timepiece of the invention.
Figure 9:
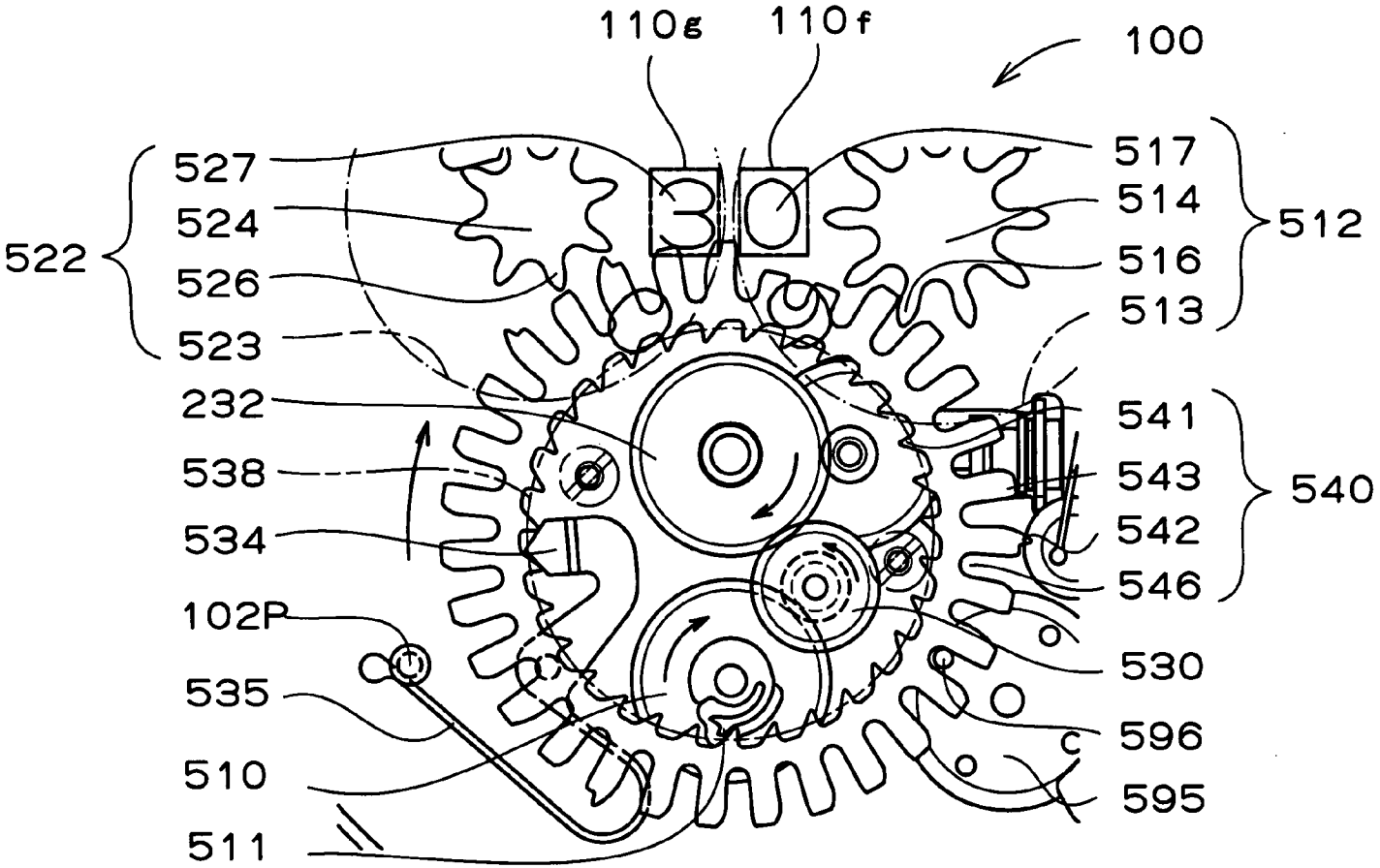
FIG. 9 is a fragmentary plan view (3) showing a structure of the date advance mechanism in the condition in which the date changes from the 29th to the 30th in the embodiment of the calendar mechanism equipped timepiece of the invention.

Referring to FIGS. 8 and 9, the first date indicator advance teeth 542 of the program wheel 540 cause the first date indicator 512 to rotate one tooth in the counterclockwise direction. By the program wheel 540 rotating one step, a first date character 517 of the first date indicator 512 disposed in the first date window 110*f* changes from "9" to "0". The one tooth's worth of rotation of the first date indicator 512 is set by the first date indicator jumper 514. At the same time, by the program wheel 540 rotating one step, the second date indicator advance fingers 543 of the second date indicator advance teeth 544 of the program wheel 540 cause the second date indicator 522 to rotate one tooth in the counterclockwise direction. By the program wheel 540 rotating one step, a second date character 527 of the second date indicator 522 disposed in the second date window 110*g* changes from "2" to "3". The one tooth's worth of rotation of the second date indicator 522 is set by the second date indicator jumper 524. With the heretofore described kind of date advance operation, it is possible to change the date displayed by the first date indicator 512 and second date indicator 522 from "29" to "30". It is preferable that the heretofore described kind of date advance operation is completed when the hour hand 356 and minute hand 352 indicate 12 hours 00 minutes.

Figure 10:
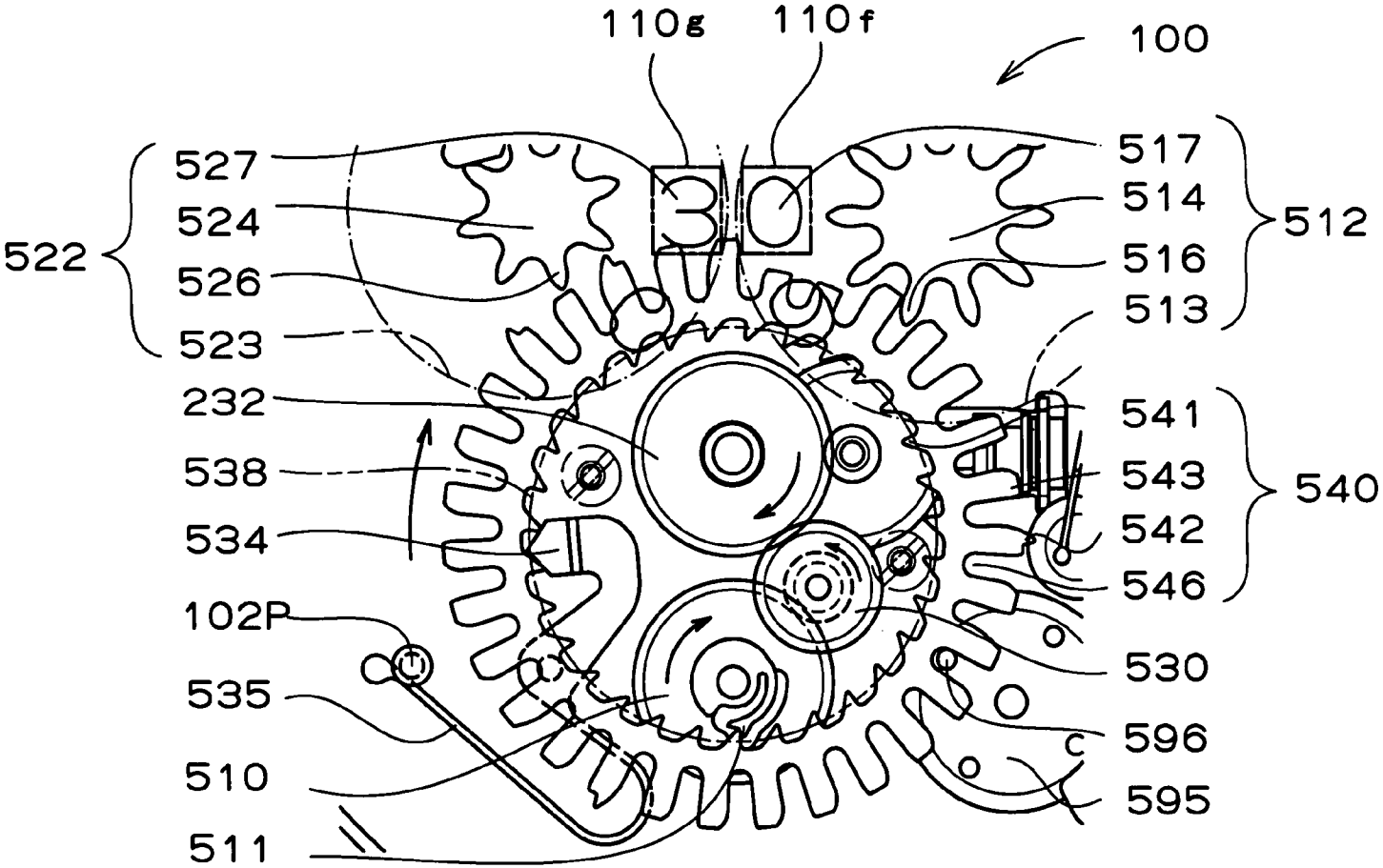
FIG. 10 is a fragmentary plan view (1) showing a structure of the date advance mechanism in a condition in which the date changes from the 30th to the 31st in the embodiment of the calendar mechanism equipped timepiece of the invention.

(1•9•2) Operation of Changing from "30th" to "31st":

Referring to FIG. 10, the condition shown in FIG. 10 is a condition in which the center position between the first date window 110*f* and second date window 110*g* is disposed in the 12 o'clock direction position of the dial 110, and the second date indicator 522 displays "3" through the second date window 110*g*, while the first date indicator 512 displays "0", thus displaying the fact that the date is the "30th".

Referring to FIGS. 10 and 25, by the hour wheel 232 rotating in the clockwise direction, the intermediate program wheel 530 rotates in the counterclockwise direction, and the program driving wheel 510 rotates once every 24 hours in the clockwise direction. The program advance pawl 511 rotates integrally based on the rotation of the program driving wheel 510. The program wheel teeth 541 of the program wheel 540 are advanced one step in the clockwise direction by means of the rotation of the program advance pawl 511.

Figure 11:
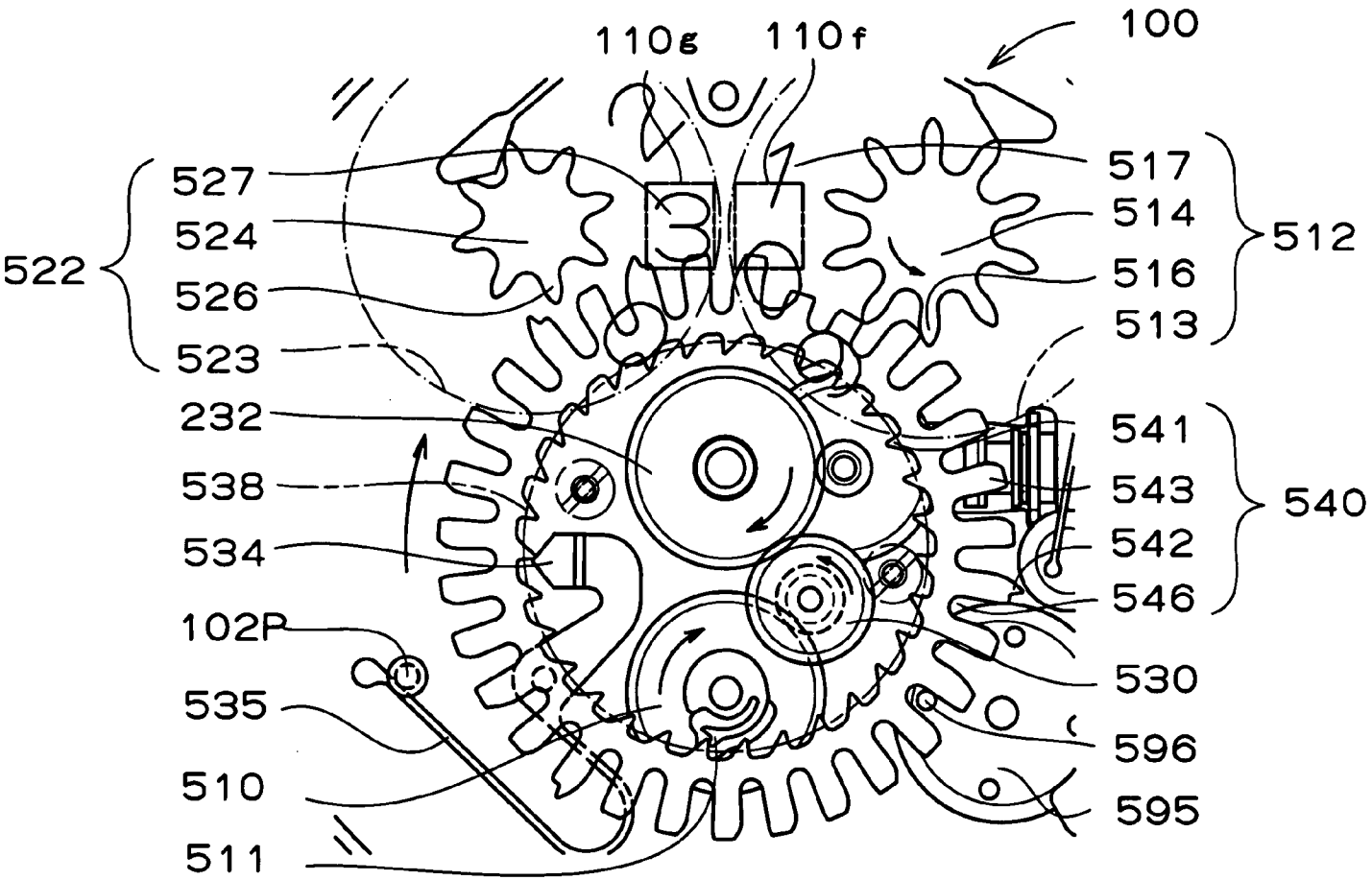
FIG. 11 is a fragmentary plan view (2) showing a structure of the date advance mechanism in the condition in which the date changes from the 30th to the 31st in the embodiment of the calendar mechanism equipped timepiece of the invention.
Figure 12:
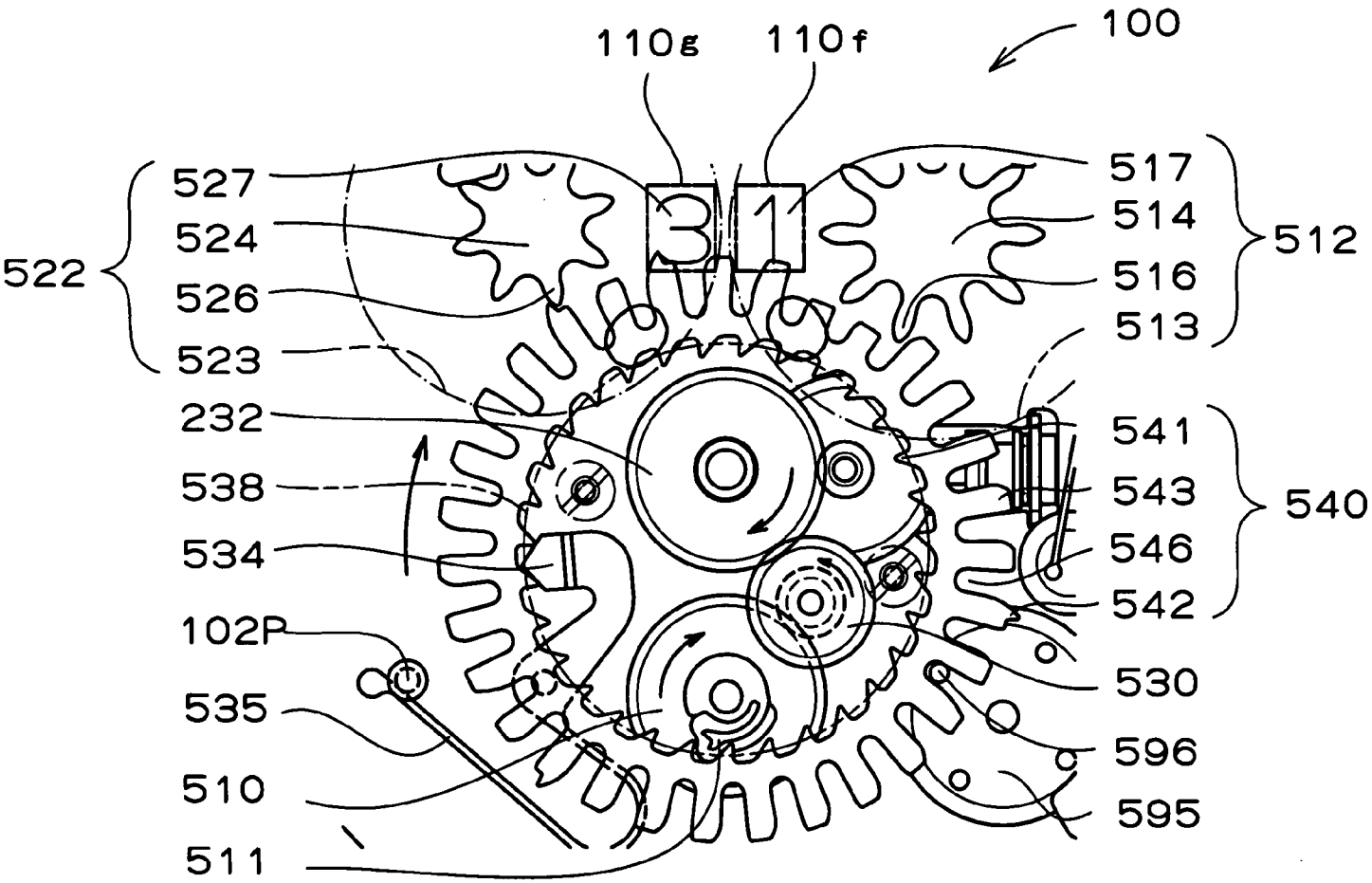
FIG. 12 is a fragmentary plan view (3) showing a structure of the date advance mechanism in the condition in which the date changes from the 30th to the 31st in the embodiment of the calendar mechanism equipped timepiece of the invention.

Referring to FIGS. 11 and 12, the first date indicator advance teeth 542 of the program wheel 540 cause the first date indicator 512 to rotate one tooth in the counterclockwise direction. By the program wheel 540 rotating one step, a first date character 517 of the first date indicator 512 disposed in the first date window 110*f* changes from "0" to "1". The one tooth's worth of rotation of the first date indicator 512 is set by the first date indicator jumper 514. At this time, even by the program wheel 540 rotating one step, it does not happen that the second date indicator 522 rotates. That is, as the second date indicator advance fingers 543 are in a position out of contact with the second date star 524, and the first date indicator advance teeth 542 are also in a position out of contact with the second date star 524, it does not happen that the second date indicator 522 rotates. In this condition, the first date indicator advance teeth 542 rotate in close proximity to the second date star 524. Consequently, by the program wheel 540 rotating one step, a second date character 527 of the second date indicator 522 disposed in the second date window 110*g* remains at "3". With the heretofore described kind of date advance operation, it is possible to change the date displayed by the first date indicator 512 and second date indicator 522 from "30" to "31". It is preferable that the heretofore described kind of date advance operation is completed when the hour hand 356 and minute hand 352 indicate 12 hours 00 minutes.

Figure 13:
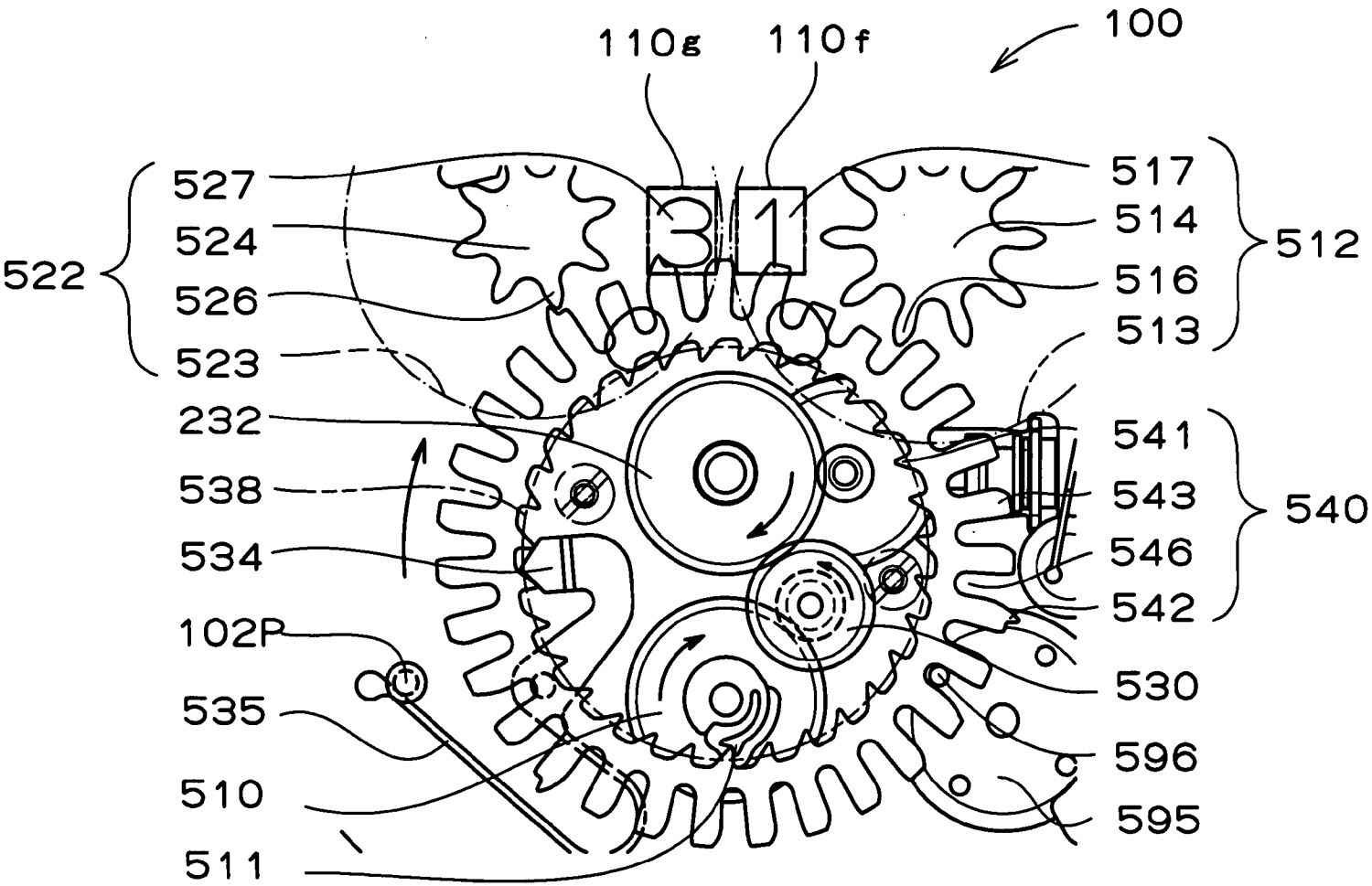
FIG. 13 is a fragmentary plan view (1) showing a structure of the date advance mechanism in a condition in which the date changes from the 31st to the 01st in the embodiment of the calendar mechanism equipped timepiece of the invention.

(1•9•3) Operation of Changing from "31st" to "01st":

Referring to FIG. 13, the condition shown in FIG. 13 is a condition in which the center position between the first date window 110*f* and second date window 110*g* is disposed in the 12 o'clock direction position of the dial 110, and the second date indicator 522 displays "3" through the second date window 110*g*, while the first date indicator 512 displays "1", thus displaying the fact that the date is the "31st".

Referring to FIGS. 13 and 25, by the hour wheel 232 rotating in the clockwise direction, the intermediate program wheel 530 rotates in the counterclockwise direction, and the program driving wheel 510 rotates once every 24 hours in the clockwise direction. The program advance pawl 511 rotates integrally based on the rotation of the program driving wheel 510. The program wheel teeth 541 of the program wheel 540 are advanced one step in the clockwise direction by means of the rotation of the program advance pawl 511.

Figure 14:
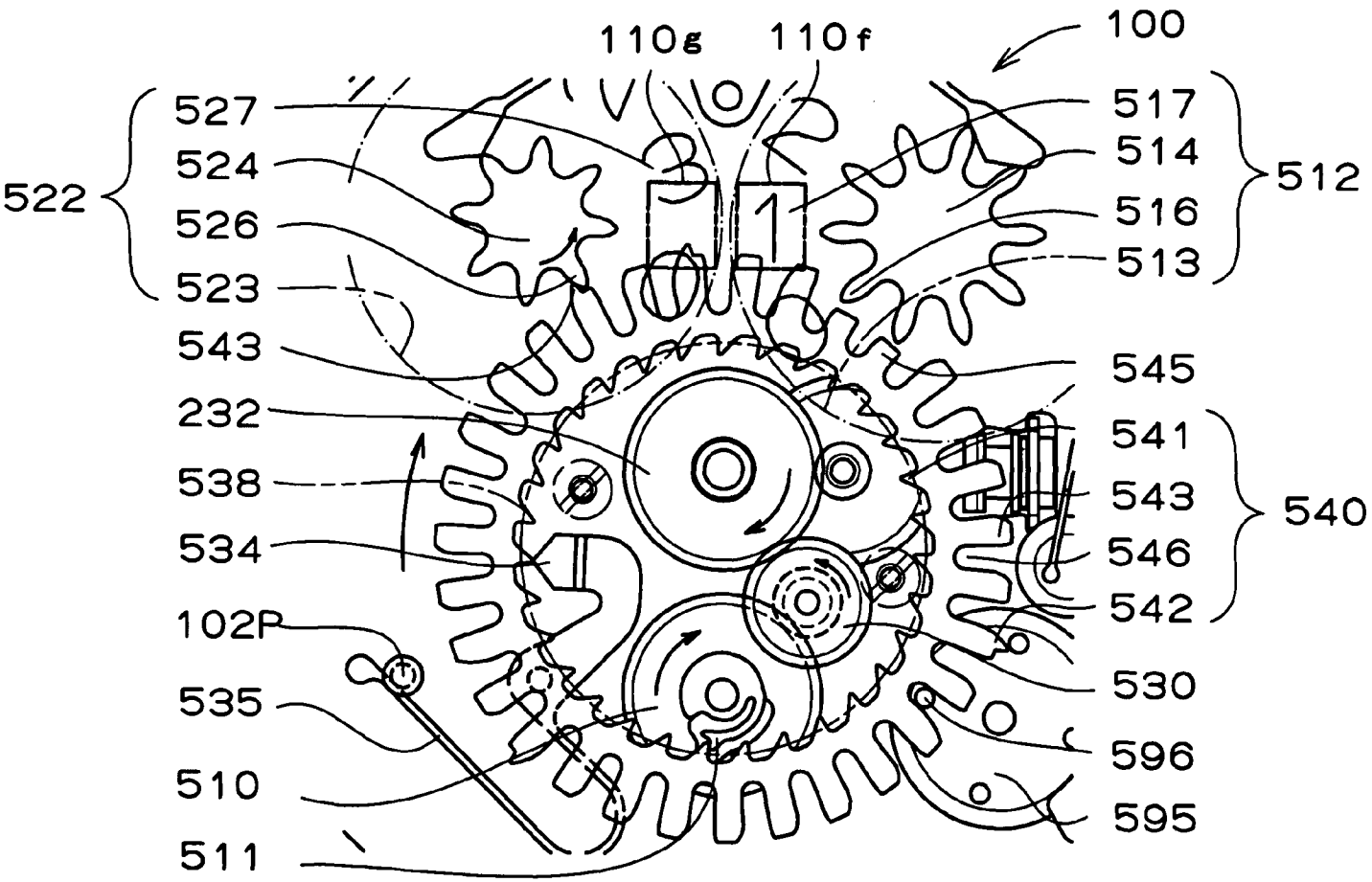
FIG. 14 is a fragmentary plan view (2) showing a structure of the date advance mechanism in the condition in which the date changes from the 31st to the 01st in the embodiment of the calendar mechanism equipped timepiece of the invention.
Figure 15:
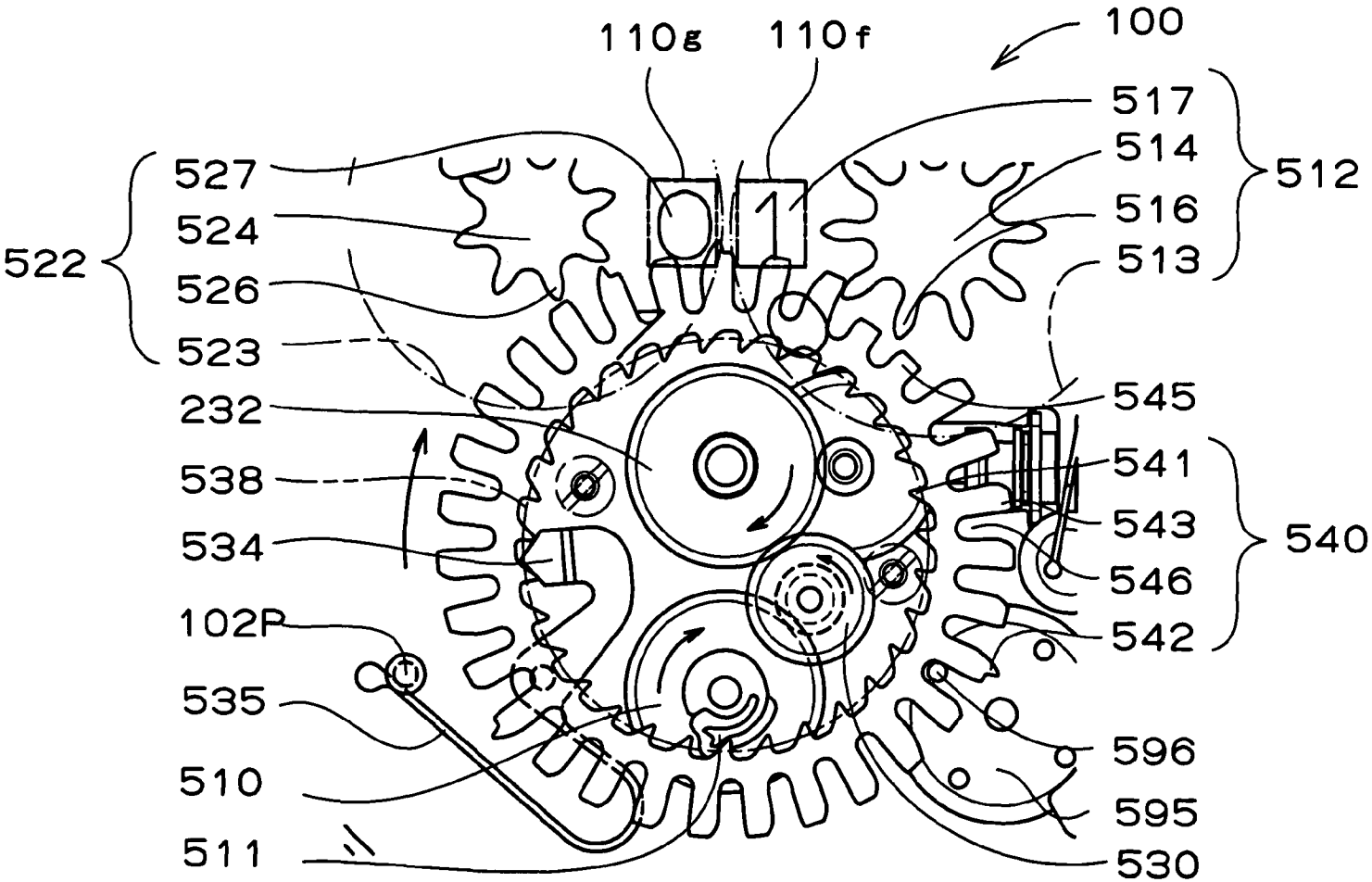
FIG. 15 is a fragmentary plan view (3) showing a structure of the date advance mechanism in the condition in which the date changes from the 31st to the 01st in the embodiment of the calendar mechanism equipped timepiece of the invention.

Referring to FIGS. 14 and 15, even by the program wheel 540 rotating, it does not happen that the first date indicator 512 rotates. That is, as the second date indicator advance fingers 543 are in a position out of contact with the first date star 514, and the first date indicator advance teeth 542 are also in a position out of contact with the first date star 514, it does not happen that the second date indicator 522 rotates. In this condition, the correction teeth 545 rotate in close proximity to the first date star 514. Consequently, by the program wheel 540 rotating one step, a first date character 517 of the first date indicator 512 disposed in the first date window 110*f* remains at "1". At the same time, by the program wheel 540 rotating one step, the second date indicator advance fingers 543 of the second date indicator advance teeth 544 of the program wheel 540 cause the second date indicator 522 to rotate one tooth in the counterclockwise direction. By the program wheel 540 rotating one step, a second date character 527 of the second date indicator 522 disposed in the second date window 110*g* changes from "3" to "0". The one tooth's worth of rotation of the second date indicator 522 is set by the second date indicator jumper 524. With the heretofore described kind of date advance operation, it is possible to change the date displayed by the first date indicator 512 and second date indicator 522 from "31" to "01". It is preferable that the heretofore described kind of date advance operation is completed when the hour hand 356 and minute hand 352 indicate 12 hours 00 minutes.

Figure 16:
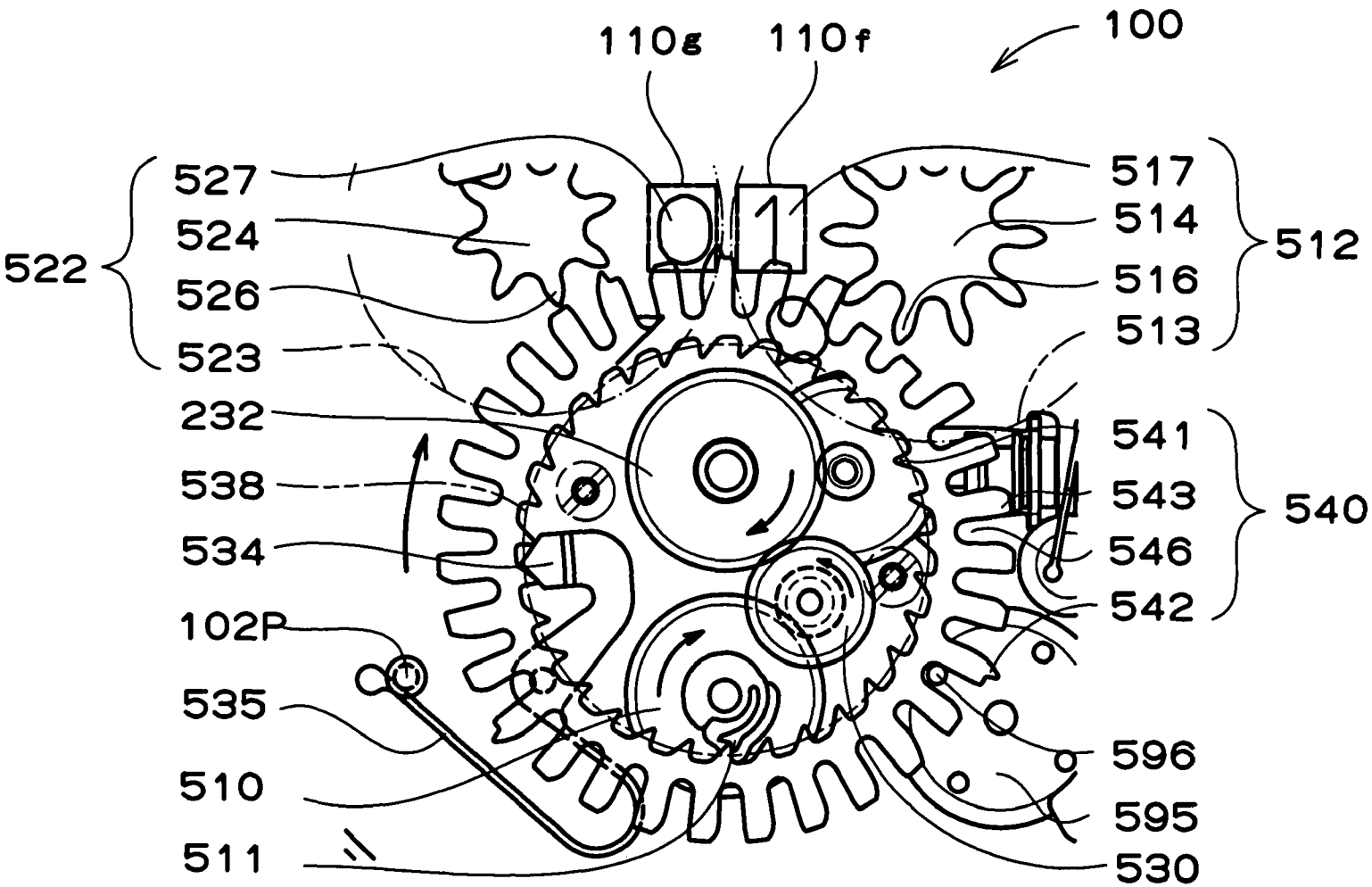
FIG. 16 is a fragmentary plan view (1) showing a structure of the date advance mechanism in a condition in which the date changes from the 01st to the 02nd in the embodiment of the calendar mechanism equipped timepiece of the invention.

(1•9•4) Operation of Changing from "01st" to "02nd":

Referring to FIG. 16, the condition shown in FIG. 16 is a condition in which the center position between the first date window 110*f* and second date window 110*g* is disposed in the 12 o'clock direction position of the dial 110, and the second date indicator 522 displays "0" through the second date window 110*g*, while the first date indicator 512 displays "1", thus displaying the fact that the date is the "01st".

Referring to FIGS. 16 and 25, by the hour wheel 232 rotating in the clockwise direction, the intermediate program wheel 530 rotates in the counterclockwise direction, and the program driving wheel 510 rotates once every 24 hours in the clockwise direction. The program advance pawl 511 rotates integrally based on the rotation of the program driving wheel 510. The program wheel teeth 541 of the program wheel 540 are advanced one step in the clockwise direction by means of the rotation of the program advance pawl 511.

Figure 17:
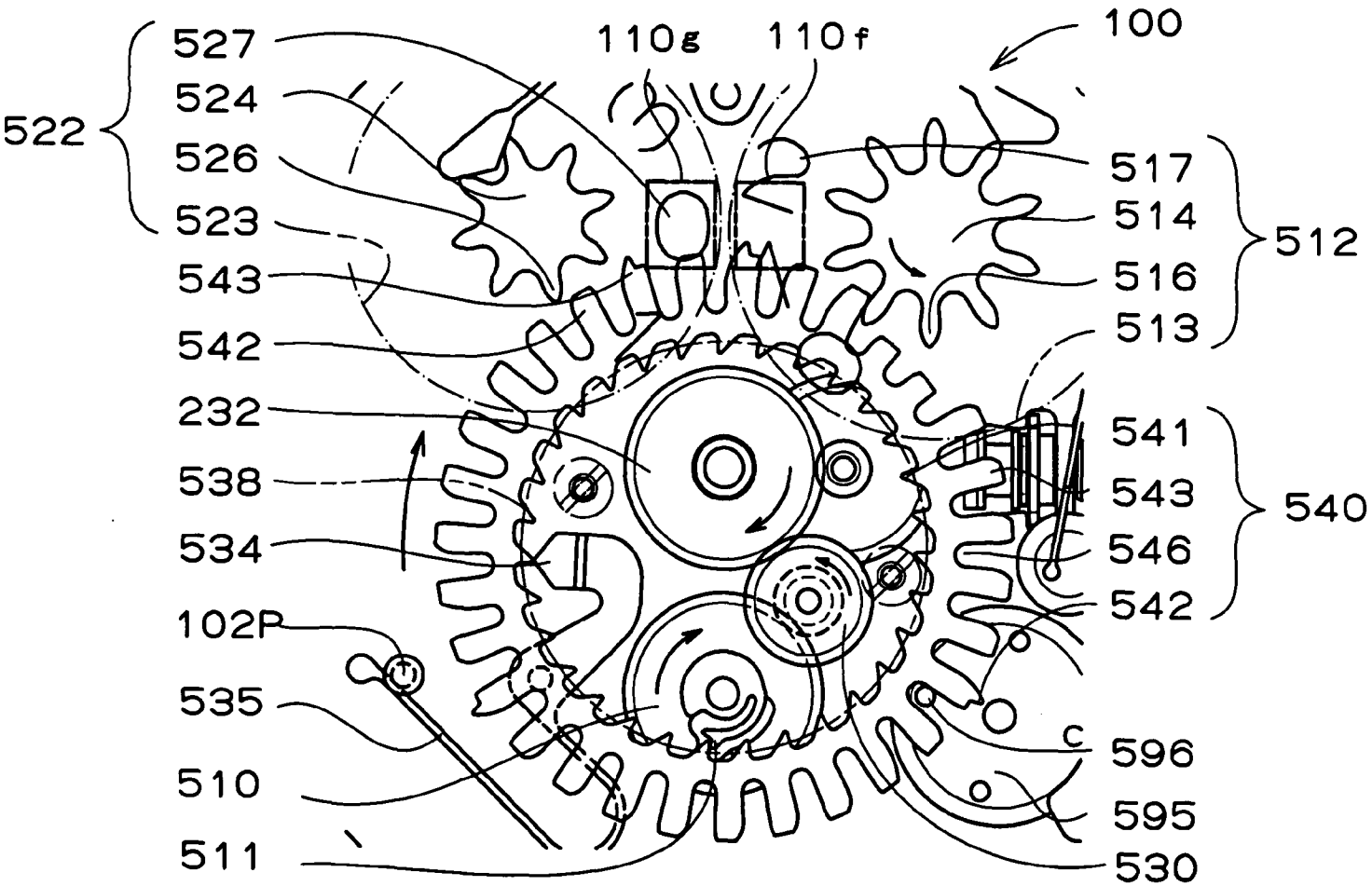
FIG. 17 is a fragmentary plan view (2) showing a structure of the date advance mechanism in the condition in which the date changes from the 01st to the 02nd in the embodiment of the calendar mechanism equipped timepiece of the invention.
Figure 18:
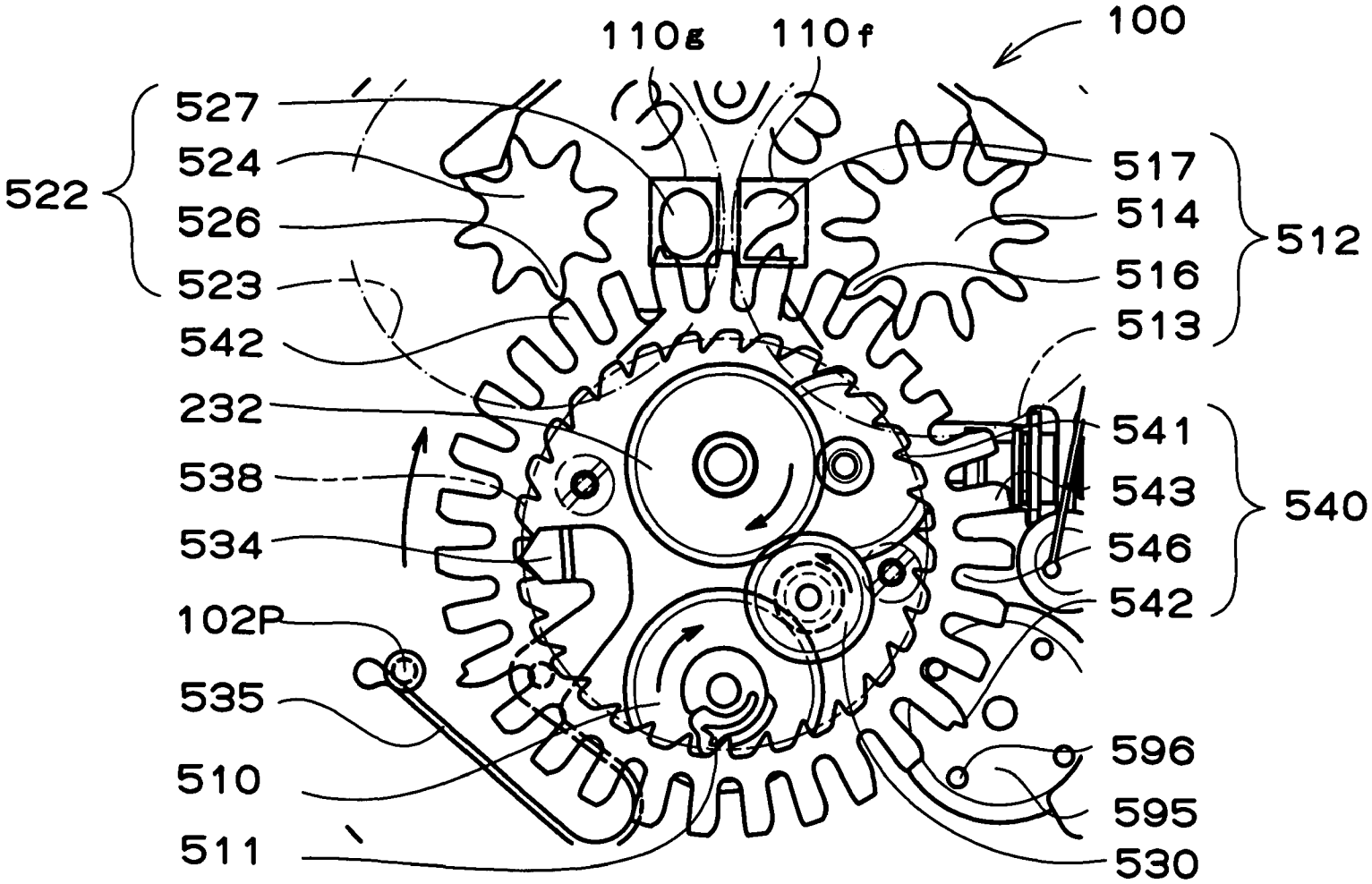
FIG. 18 is a fragmentary plan view (3) showing a structure of the date advance mechanism in the condition in which the date changes from the 01st to the 02nd in the embodiment of the calendar mechanism equipped timepiece of the invention.

Referring to FIGS. 17 and 18, the first date indicator advance teeth 542 of the program wheel 540 cause the first date indicator 512 to rotate one tooth in the counterclockwise direction. By the program wheel 540 rotating one step, a first date character 517 of the first date indicator 512 disposed in the first date window 110*f* changes from "1" to "2". The one tooth's worth of rotation of the first date indicator 512 is set by the first date indicator jumper 514. At the same time, by the program wheel 540 rotating one step, it does not happen that the second date indicator 522 rotates. That is, as the second date indicator advance fingers 543 are in a position out of contact with the second date star 524, and the first date indicator advance teeth 542 are also in a position out of contact with the second date star 524, it does not happen that the second date indicator 522 rotates. In this condition, the first date indicator advance teeth 542 rotate in close proximity to the second date star 524. Consequently, by the program wheel 540 rotating one step, a second date character 527 of the second date indicator 522 disposed in the second date window 110*g* remains at "0". With the heretofore described kind of date advance operation, it is possible to change the date displayed by the first date indicator 512 and second date indicator 522 from "01" to "02". It is preferable that the heretofore described kind of date advance operation is completed when the hour hand 356 and minute hand 352 indicate 12 hours 00 minutes. Other date advance operations are also carried out in the same way as any of the heretofore described four types.

With the calendar mechanism equipped timepiece of the invention, as it is possible to carry out the heretofore described kinds of operation once every day, it is possible to display the ones column (that is, "0", "1", "2", "3", "4", "5", "6", "7", "8", and "9") of the date by means of the first date indicator 512, and display the tenths column (that is, "0", "1", "2", and "3") of the date by means of the second date indicator 522. Consequently, with the calendar mechanism equipped timepiece of the invention, it is possible, through the first date window 110*f* and second date window 110*g*, to reliably display the "01st" to the "31st" in date characters of a dimension larger than those of a heretofore known calendar mechanism equipped timepiece.

(1•10) Calendar Correction Mechanism:

Referring to FIGS. 1 and 5, a calendar correction mechanism includes a first calendar corrector wheel 591, a second calendar corrector wheel 592, a third calendar corrector wheel 593, a fourth calendar corrector wheel 594, a corrector wheel 595, and a calendar corrector wheel holder spring 597. The calendar corrector wheel holder spring 597 can be formed integrally with a calendar corrector wheel holder 598. In the condition in which the winding stem 118 is placed in the 0th step, the first calendar corrector wheel 591 is rotatably supported on the first calendar corrector wheel guide 118*e* of the winding stem 118. That is, the first calendar corrector wheel 591 and winding stem 118 are disposed so as to be coaxial with each other. The second calendar corrector wheel 592 is rotatably supported on the main plate 102.

The calendar corrector wheel holder 598 rotatably supports the second calendar corrector wheel 592 on the main plate 102. The third calendar corrector wheel 593 is rotatably supported on the main plate 102. The fourth calendar corrector wheel 594 is supported on the main plate 102 in such a way as to oscillate through a certain angle and be rotatable in a position to which it has oscillated. The fourth calendar corrector wheel 594 is configured so as to be able to oscillate along a guide hole provided in the main plate 102. The calendar corrector wheel holder spring 597 is configured so as to cause the fourth calendar corrector wheel 594 to apply an elastic force to the main plate 102. The corrector wheel 595 is rotatably supported on the main plate 102. Correction pins 596 for rotating the program wheel 540 are provided on the corrector wheel 595. Although four correction pins are illustrated, the number of correction pins may also be one, and may also be plural.

Referring to FIGS. 1 and 5, a configuration is such that, in the condition in which the winding stem 118 is in the 1st step, a corrector transmission spring provided integrally with the first calendar corrector wheel 591 meshes with the key groove of the winding stem 118, and the first calendar corrector wheel 591 rotates based on the rotation of the winding stem 118. A configuration is such that, in this condition, on the winding stem 118 being rotated in a first direction, the second calendar corrector wheel 592 rotates in the clockwise direction based on the rotation of the first calendar corrector wheel 591. The third calendar corrector wheel 593 rotates in the counterclockwise direction based on the rotation of the second calendar corrector wheel 592. Based on the rotation of the third calendar correction wheel 593, the fourth calendar corrector wheel 594 oscillates to a position in which the teeth of the fourth calendar corrector wheel 594 mesh with the teeth of the corrector wheel 595, and stops. In this correction position, the fourth calendar corrector wheel 594 rotates in the clockwise direction, based on which rotation the corrector wheel 595 rotates in the counterclockwise direction. On the corrector wheel 595 rotating, the correction pins 596 enter the corrector advance grooves 546 of the program wheel 540, thus enabling the program wheel 540 to rotate in the clockwise direction.

Figure 19:
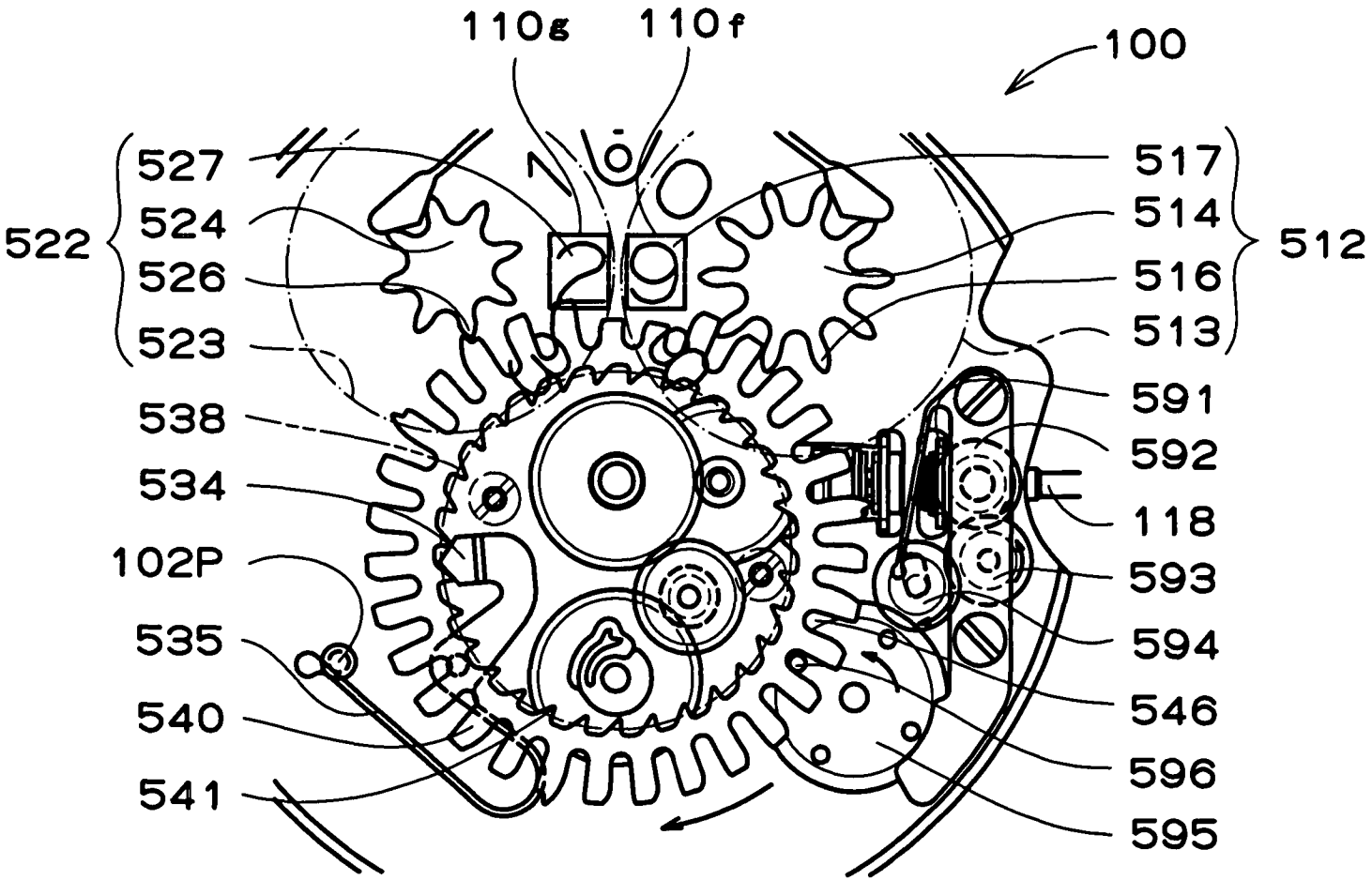
FIG. 19 is a fragmentary plan view (1) showing a structure of the date advance mechanism in a condition in which the date changes from the 29th to the 30th for date correction in the embodiment of the calendar mechanism equipped timepiece of the invention.

Referring to FIG. 19, the condition shown in FIG. 19 is a condition in which the center position between the first date window 110*f* and second date window 110*g* is disposed in the 12 o'clock direction position of the dial 110, and the second date indicator 522 displays "2" through the second date window 110*g*, while the first date indicator 512 displays "9", thus displaying the fact that the date is the "29th".

Figure 20:
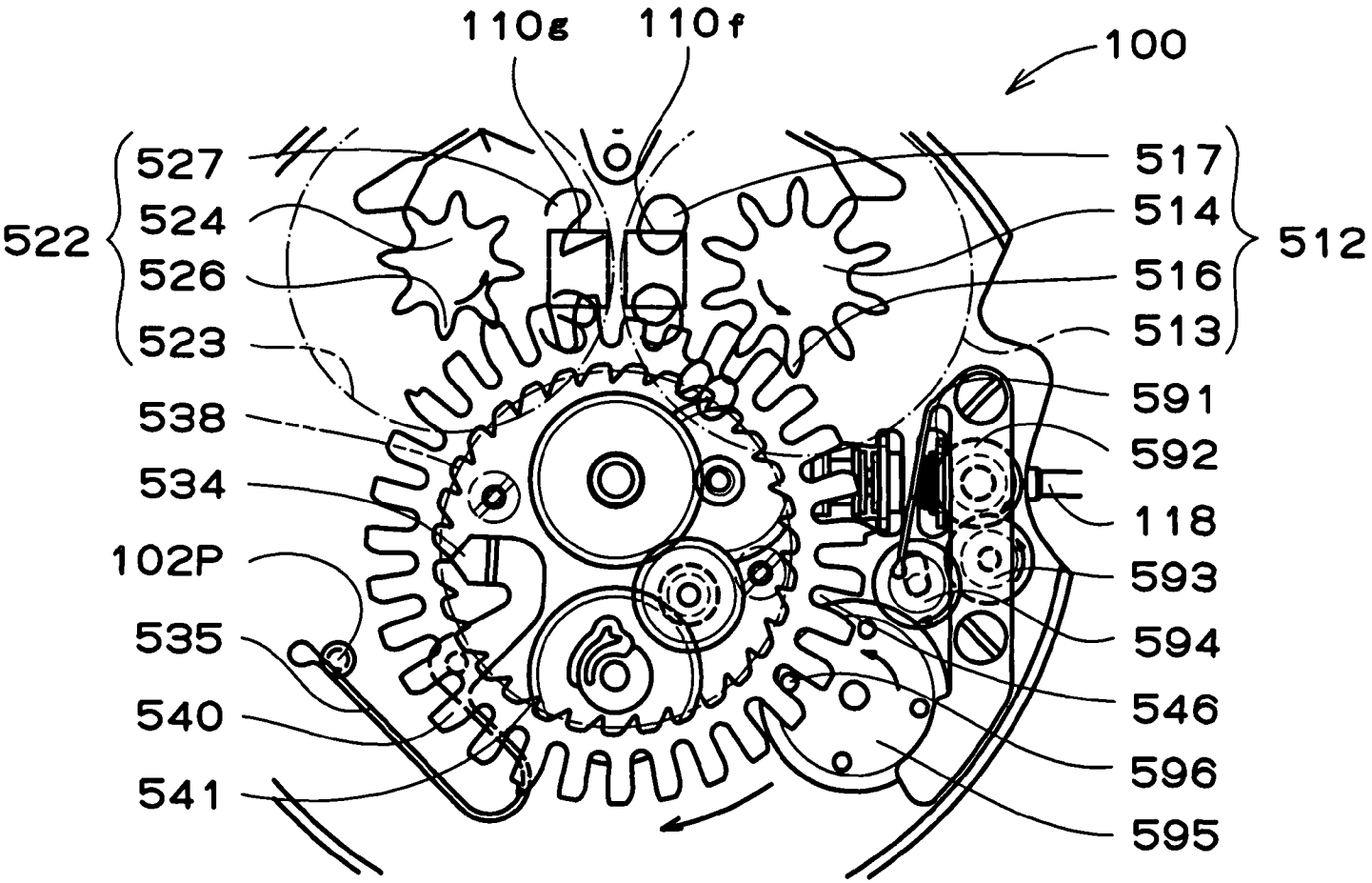
FIG. 20 is a fragmentary plan view (2) showing a structure of the date advance mechanism in the condition in which the date changes from the 29th to the 30th for date correction in the embodiment of the calendar mechanism equipped timepiece of the invention.

Referring to FIG. 20, on the winding stem 118 being rotated in the heretofore described first direction in the condition in which the winding stem 118 is pulled out to the 1st step, the program wheel 540 rotates one tooth in the clockwise direction, thus enabling the first date indicator 512 to be rotated one tooth in the counterclockwise direction by the first date indicator advance teeth 542. At the same time, by the program wheel 540 rotating in the clockwise direction, the second date indicator 522 can be rotated one tooth in the counterclockwise direction by the second date indicator advance fingers 543 of the second date indicator advance teeth 544.

Figure 21:
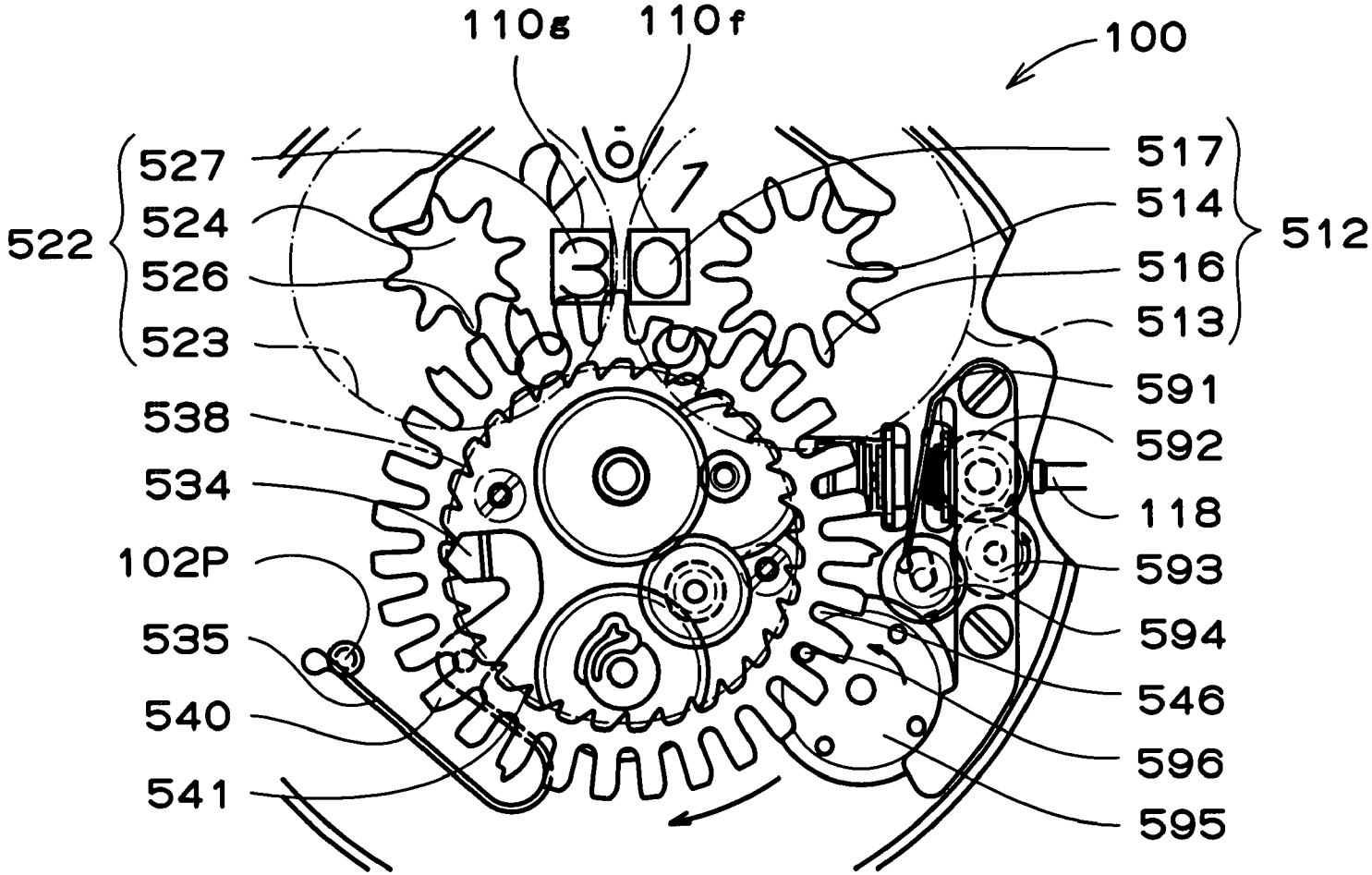
FIG. 21 is a fragmentary plan view (3) showing a structure of the date advance mechanism in the condition in which the date changes from the 29th to the 30th for date correction in the embodiment of the calendar mechanism equipped timepiece of the invention.

Referring to FIGS. 20 and 21, on the winding stem 118 being rotated in the heretofore described first direction in the condition in which the winding stem 118 is pulled out to the 1st step, the program wheel 540 rotates one tooth in the clockwise direction, and the first date indicator advance teeth 542 of the program wheel 540 cause the first date indicator 512 to rotate one tooth in the counterclockwise direction. By the program wheel 540 rotating one step, a first date character 517 of the first date indicator 512 disposed in the first date window 110*f* changes from "9" to "0". The one tooth's worth of rotation of the first date indicator 512 is set by the first date indicator jumper 514. At the same time, by the program wheel 540 rotating one step, the second date indicator advance fingers 543 of the second date indicator advance teeth 544 of the program wheel 540 cause the second date indicator 522 to rotate one tooth in the counterclockwise direction. By the program wheel 540 rotating one step, a second date character 527 of the second date indicator 522 disposed in the second date window 110*g* changes from "2" to "3". The one tooth's worth of rotation of the second date indicator 522 is set by the second date indicator jumper 524. With the heretofore described kind of date correction operation, it is possible to change the date displayed by the first date indicator 512 and second date indicator 522 from "29" to "30".

For example, in a condition in which the second date indicator 522 displays "3" though the second date window 110*g*, and the first date indicator 512 displays "1", thus displaying the fact that the date is the "31st", on the winding stem 118 being rotated in the heretofore described first direction in the condition in which the winding stem 118 is pulled out to the 1st step, the program wheel 540 rotates one tooth in the clockwise direction, and it does not happen that the first date indicator 512 rotates, so a first date character 517 of the first date indicator 512 disposed in the first date window 110*f* remains at "1". At the same time, by the program wheel 540 rotating one step, the second date indicator advance fingers 543 of the second date indicator advance teeth 544 of the program wheel 540 cause the second date indicator 522 to rotate one tooth in the counterclockwise direction. By the program wheel 540 rotating one step, a second date character 527 of the second date indicator 522 disposed in the second date window 110*g* changes from "3" to "0". The one tooth's worth of rotation of the second date indicator 522 is set by the second date indicator jumper 524. With the heretofore described kind of date correction operation, it is possible to change the date displayed by the first date indicator 512 and second date indicator 522 from "31" to "01". With regard to other dates, a correction of the display of the first date characters 517 of the first date indicator 512, as well as a correction of the display of the second date characters 527 of the second date indicator 522, can be carried out in the same way as with the heretofore described details.

As the calendar mechanism equipped timepiece of the invention is configured so as to display the "1st" to the "31st" every month, a date correction at the end of the month is carried out only at the end of February, the end of April, the end of June, the end of September, and the end of November. Consequently, with the calendar mechanism equipped timepiece of the invention, the frequency of carrying out the date correction at the end of the month is five times a year.

(2) Second Embodiment

Next, a description will be given of a second embodiment of the calendar mechanism equipped timepiece of the invention. Hereafter, a description will be mainly given of points in which the second embodiment of the calendar mechanism equipped timepiece of the invention differs from the first embodiment of the calendar mechanism equipped timepiece of the invention. Consequently, with regard to a point which is not described hereafter, the description of the heretofore described first embodiment of the calendar mechanism equipped timepiece of the invention shall be applied hereto. The second embodiment of the calendar mechanism equipped timepiece of the invention is an analog electronic timepiece.

Figure 26:
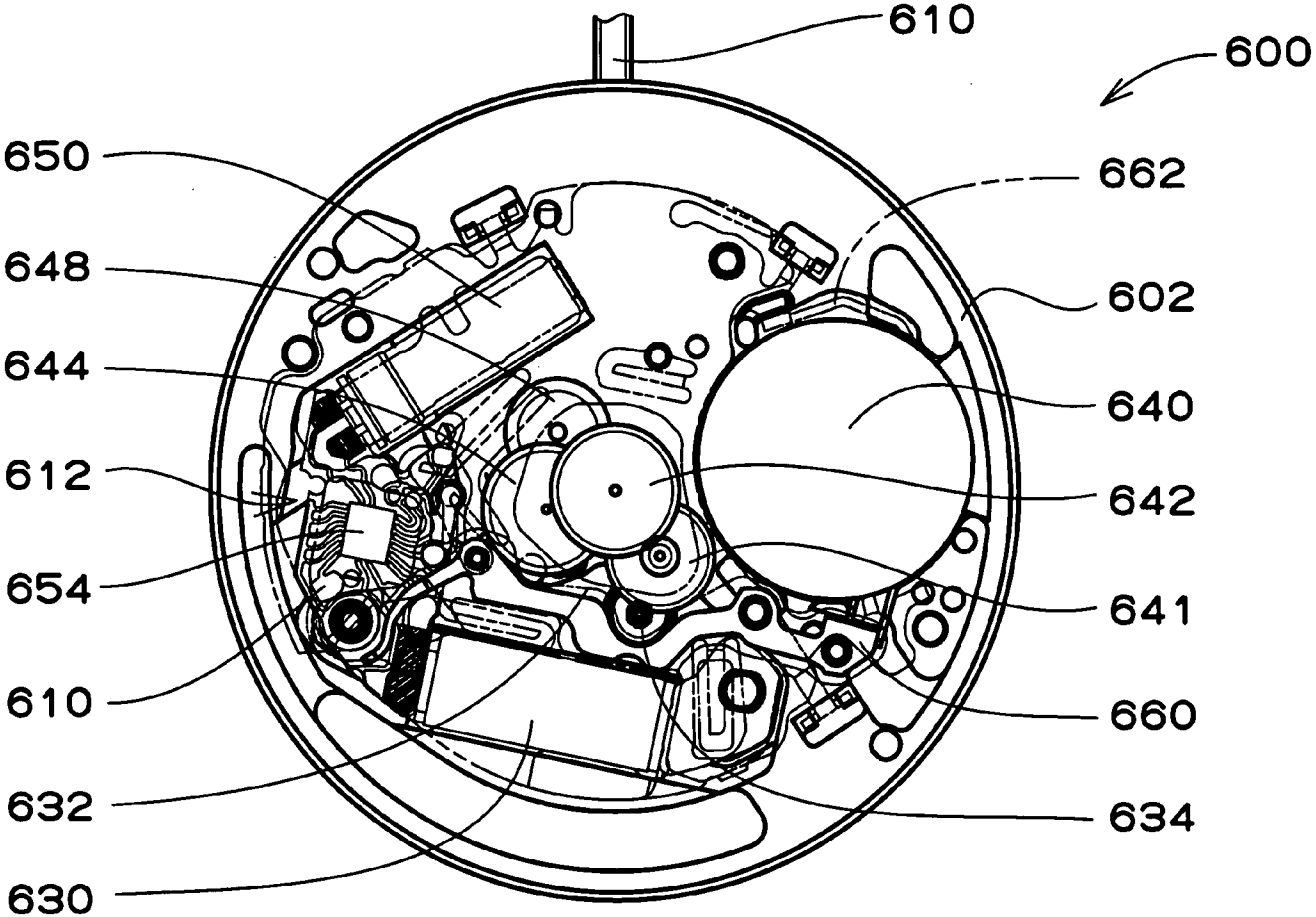
FIG. 26 is an outline plan view showing a structure when looking at a movement from the case back side in a second embodiment of the calendar mechanism equipped timepiece of the invention.

Referring to FIG. 26, a movement 600 is configured of an analog electronic timepiece. The movement 600 includes a main plate 602 configuring the substrate of the movement. A dial (not shown) is mounted on the glass side of the movement 600. A winding stem 601 is rotatably mounted in the main plate 602. A switching device includes the winding stem 601, a setting lever (not shown), a yoke (not shown), and a yoke holder (not shown). A setting device includes a setting lever (not shown). In the movement 600, a battery 640 configuring the power source of the timepiece is disposed on the case back side (front side) of the main plate 602. A crystal oscillator unit 650 configuring the oscillation source of the timepiece is disposed on the case back side of the main plate 602. A crystal oscillator is housed in the crystal oscillator unit 650. A motor driver which, based on the oscillation of the crystal oscillator, outputs a motor drive signal to a step motor is built into an integrated circuit (IC) 654.

The crystal oscillator unit 650 and integrated circuit 654 are fixed to a circuit substrate 610. The circuit substrate 610, crystal oscillator unit 650, and integrated circuit 654 configure a circuit block 612. The circuit block 612 is disposed on the case back side of the main plate 602. A battery minus terminal 660 is provided in order to cause the anode of the battery 640 and the minus pattern of the circuit substrate 610 to be continuous. A battery plus terminal 662 is provided in order to cause the cathode of the battery 640 and the plus pattern of the circuit substrate 610 to be continuous. A coil block 630, a stator 632, and a rotor 634, which configure the step motor, are disposed on the case back side of the main plate 602.

A configuration is such that a fifth wheel & pinion 641 rotates by means of the rotation of the rotor 634. A configuration is such that a second wheel & pinion 642 rotates by means of the rotation of the fifth wheel & pinion 641. A configuration is such that a third wheel & pinion 644 rotates by means of the rotation of the second wheel & pinion 642. A configuration is such that a center wheel & pinion (not shown) rotates by means of the rotation of the third wheel & pinion 644. A configuration is such that a minute wheel 648 rotates by means of the rotation of the center wheel & pinion. A configuration is such that an hour wheel (not shown) rotates by means of the rotation of the minute wheel 648. An hour hand (not shown) is mounted on the hour wheel. The hour wheel is configured so as to rotate once every 12 hours. The setting lever is configured so as not to set the teeth of the second wheel & pinion 642 or fifth wheel & pinion 641 when the winding stem 601 is in the 0th step, and when the winding stem 601 is in the 1st step. The setting lever is configured so as to set the teeth of the second wheel & pinion 642 or fifth wheel & pinion 641 when the winding stem 601 is in the 2nd step.

The second wheel & pinion 642 is configured so as to rotate once a minute. The center wheel & pinion is configured so as to rotate once an hour. A slip mechanism is provided on the center wheel & pinion. When the winding stem 601 is pulled out to the 2nd step to carry out a hand setting, the setting lever (not shown) sets the teeth of the second wheel & pinion 642 or fifth wheel & pinion 641, and stops the rotation of a second hand. A central tube (not shown) is fixed to the main plate 602. The central tube extends from the case back side of the main plate 602 to the dial side of the main plate 602. A train wheel bridge (not shown) which rotatably supports a front train wheel is disposed on the case back side of the main plate 602.

On the back side of the movement 600, a date advance mechanism (not shown) can be operated by means of the rotation of an intermediate program wheel by means of the rotation of the hour wheel. A configuration and operation of the date advance mechanism in the second embodiment of the calendar mechanism equipped timepiece of the invention are the same as the configuration and operation of the date advance mechanism in the heretofore described first embodiment of the calendar mechanism equipped timepiece of the invention.

A calendar advance operation, a date correction operation, and the like, of the second embodiment of the calendar mechanism equipped timepiece of the invention are the same as the operations of the first embodiment of the calendar mechanism equipped timepiece of the invention. That is, a configuration is such that by the hour wheel rotating, the program driving wheel 510 rotates once every 24 hours by means of the rotation of the intermediate program wheel 530. The program advance pawl 511 is configured so as to rotate integrally based on the rotation of the program driving wheel 510. With this configuration, it is possible to reduce the area of the calendar mechanism equipped timepiece occupied by the drive mechanism which drives the first date indicator 512 and second date indicator 522.

The calendar mechanism equipped timepiece of the invention including the first date indicator, which displays the ones column of the date, and the second date indicator, which displays the tenths column of the date, it is possible to reliably display the date in large characters, and moreover, it is possible to manufacture a calendar mechanism equipped timepiece which is thin and has less design constraint. The calendar mechanism equipped timepiece of the invention has a good operability without increasing the number of times the calendar mechanism has to be corrected at the end of the month.

What is claimed is:

1. A calendar mechanism equipped timepiece which displays the date with two date indicators, comprising:

a drive mechanism for driving the calendar mechanism equipped timepiece;

time display wheels which rotate by means of the operation of the drive mechanism and display time information;

a first date indicator which displays the ones column of the date;

a second date indicator which displays the tenths column of the date; and a program wheel configured so as to enable each of the first date indicator and second date indicator to rotate intermittently based on the operation of the drive mechanism, wherein the program wheel includes: program wheel teeth for receiving the operation of the drive mechanism and advancing the program wheel; first date indicator advance teeth configured so as to advance the first date indicator; second date indicator advance teeth which can advance the first date indicator, and have provided at the leading ends thereof second date indicator advance fingers for advancing the second date indicator; and correction teeth configured so as to be unable to advance the first date indicator and unable to advance the second date indicator, wherein the first date indicator advance teeth, second date indicator advance teeth, and correction teeth are disposed on the outer side of the program wheel, the height of the second date indicator advance teeth is configured so as to be greater than the height of the first date indicator advance teeth, and the height of the first date indicator advance teeth is configured so as to be greater than the height of the correction teeth, the program wheel teeth for advancing the program wheel are provided on the program wheel as internal teeth, and the first date indicator and second date indicator, whose perimeters are positioned in proximity to each other, are configured so that it is possible to display information relating to the date with one of first date characters provided on the first date indicator and one of second date characters provided on the second date indicator.

2. A calendar mechanism equipped timepiece according to claim 1, wherein the program wheel, having 31 program wheel teeth for receiving the operation of the drive mechanism, is configured so that the number of first date indicator advance teeth provided is 25, the number of second date indicator advance teeth provided is four, and the number of correction teeth provided is two, and the program wheel is configured in a kind of shape which is in one plane.

3. A calendar mechanism equipped timepiece according to claim 1, wherein in the first date indicator, first date characters formed of ten numbers are provided on a first date character display surface, and the first date characters are circumferentially disposed in the order of "0", "1", "2", "3", "4", "5", "6", "7", "8", and "9", and in the second date indicator, second date characters formed of eight numbers are provided on a second date character display surface, and the second date characters are circumferentially disposed in the order of "0", "1", "2", "3", "0", "1", "2", and "3".

4. A calendar mechanism equipped timepiece according to claim 1, further comprising:

a calendar correction mechanism with which, in a condition in which a winding stem is pulled out to a winding stem position in which a calendar correction can be made, by the winding stem being rotated, it is possible to correct the display details of the first date indicator and the display details of the second date indicator, wherein the calendar correction mechanism, including a corrector wheel, is configured so that, in the condition in which the winding stem is pulled out to a winding stem position in which a calendar correction can be made, by the corrector wheel rotating based on the rotation of the winding stem, a correction pin provided on the corrector wheel enters a corrector advance groove of the program wheel, thus enabling the program wheel to rotate.

5. A calendar mechanism equipped timepiece according to claim 1, wherein the position of the rotation center of the program wheel is disposed in a position which, being on the opposite side of positions in which a first date character and a second date character are displayed through windows in the dial from the positions of the rotation centers of the time display wheels, is eccentric from the positions of the rotation centers of the time display wheels.

* * * * *